6/30/87 XR 4,676,310

United States Patent [19]

Scherbatskoy et al.

[11] Patent Number: 4,676,310

[45] Date of Patent: Jun. 30, 1987

[54] APPARATUS FOR TRANSPORTING MEASURING AND/OR LOGGING EQUIPMENT IN A BOREHOLE

[76] Inventors: Serge A. Scherbatskoy, 3921 Clayton Rd. E., Fort Worth, Tex. 76116; Jacob Neufeld, 113 Cedar La., Oak Ridge, Tenn. 37830

[21] Appl. No.: 836,304

[22] Filed: Mar. 5, 1986

Related U.S. Application Data

[63] Continuation of Ser. No. 397,157, Jul. 12, 1982, abandoned.

[51]* Int. Cl.[4] ..... E21B 33/127

[52] U.S. Cl. ..... 166/65.1; 166/113; 166/155; 166/187; 166/383; 175/40; 73/151; 254/134.4

[58] Field of Search ..... 166/65.1, 66, 104, 113, 166/153, 155, 187, 250, 383; 175/40, 50, 323, 27; 73/151, 152; 367/25, 81, 83; 254/134.4, 93 HP

[56] References Cited

U.S. PATENT DOCUMENTS

| | | | |
|---|---|---|---|
| 2,650,314 | 8/1953 | Hennigh et al. . | |
| 3,059,695 | 10/1962 | Bully et al. | 166/187 |
| 3,395,725 | 8/1968 | Talley, et al. | 166/155 |
| 3,437,169 | 4/1969 | Youmans . | |
| 3,554,284 | 6/1971 | Nystrom | 166/250 |
| 4,031,750 | 6/1977 | Youmans et al. | 73/151 |
| 4,109,521 | 8/1978 | Youmans | 73/151 |
| 4,113,239 | 9/1978 | Neinast | 254/134.4 |
| 4,243,099 | 1/1981 | Rodgers, Jr. | 166/250 |
| 4,491,186 | 1/1985 | Alder | 175/27 |

FOREIGN PATENT DOCUMENTS

| | | | |
|---|---|---|---|
| 213731 | 3/1967 | U.S.S.R. | 166/250 |
| 47808 | of 1975 | U.S.S.R. | 166/250 |

*Primary Examiner*—Stephen J. Novosad
*Assistant Examiner*—William P. Neuder
*Attorney, Agent, or Firm*—Head Johnson Stevenson

[57] ABSTRACT

Apparatus for transporting measuring and/or logging equipment in a borehole filled with drilling fluid, the apparatus being in the form of a transporter body of normal diameter less than that of the borehole characterized by apparatus for effectively advancing the transporter in a borehole and for reducing the possibility that the transporter will become stuck in a borehole.

21 Claims, 20 Drawing Figures

TERMINAL
264
268
266
270
272
270A
274
MOMENTORY SWITCH
276

250
BIDIRECTIONAL LOCKING RELAY SWITCH
UP
DOWN
248
262
252
PROPELLER MOTOR
210
214

220
218
262
MEMORY
228
226
CONTROLLER
MEMORY
234
236
CONTROLLER
MEMORY
242
244
CONTROLLER
THRESHOLD
260
RECTIFIER
258
BPF
256
A-D CONVERTOR
224
A-D CONVERTOR
232
A-D CONVERTOR
240
246
LITHOLOGY SENSOR
216
COLLAR LOCATOR
230
PRESSURE SENSOR
238
AC MAGNETOMETER
254

APPARATUS FOR TRANSPORTING MEASURING AND/OR LOGGING EQUIPMENT IN A BOREHOLE

This application is a continuation of application Ser. No. 397,157, filed July 12, 1982 now abandoned.

BACKGROUND OF THE INVENTION

In drilling oil and gas wells, it is important that geologists and engineers have as much knowledge as possible of the characteristics of the earth formations through which the well passes. Such knowledge is useful for effectively completing a well in a borehole which has been drilled, and is exceedingly helpful in determining the overall characteristics of hydrocarbon producing formations for planning the drilling of additional adjacent wells. For these reasons a large industry has emerged for performing the services of well logging.

The process of providing information as to conditions in boreholes in the earth can be accomplished while drilling by transmitting information up the borehole such as revealed in U.S. Pat. No. 3,964,556, issued to Marvin Gearhart et al, entitled: "Downhole Signalling System". While this method of conveying downhole information while drilling is extremely important and gaining in acceptance by the petroleum industry, nevertheless, the most common means of providing downhole information is practiced by lowering tools in a borehole by means of a cable extending from the earth's surface.

When a well to be logged is vertical, or nearly vertical, logging tools can be effectively run in the borehole by means of a cable since the weight of the tools and the weight of the cable is sufficient to overcome any friction of the tool and cable against the borehole wall. However, difficulty is experienced if the borehole is inclined relative to the vertical. In recent years more and more boreholes are drilled wherein at least a portion of the borehole is at an angle relative to the vertical. This is especially true in drilling boreholes from offshore drilling platforms wherein it is desirable to drill as many wells as possible from a single platform location and in which it is important that the producing formation be penetrated at distances as far as possible from the location of the platform.

When boreholes are inclined relative to the vertical, impediments to the passage of a logging tool suspended by a cable can seriously interfere when such impediments would normally be of no concern if the borehole is vertical or near vertical. In drilling through various formations, the diameter of the borehole may be enlarged for short lengths due to erosion by the drilling fluid. These enlargements in the diameter of the borehole can cause recesses or pockets in inclined boreholes which tend to trap a tool suspended on a cable when the tool is being lowered by gravity into the borehole.

When an operator is unable to cause a logging tool suspended on a cable from going to the bottom of the borehole, a serious problem develops. In present practice, the only practical alternative is for the logging tool to be pushed to the bottom by means of a drill string. This is time consuming, expensive, and, in addition, the drill string tends to damage the logging tool cable since the cable and drill string must be inserted into the borehole simultaneously.

For these reasons it is highly desirable that a more effective method of moving a logging tool to the bottom of a borehole for well logging be devised. In attempting to overcome these problems, others have provided apparatus intending to pull a cable supported logging tool in a borehole. As an example of the effort of others, reference may be had to the following U.S. Pat. Nos.:

| | |
|---|---|
| 2,776,564 | 4,192,380 |
| 3,554,284 | 4,166,500 |
| 3,550,684 | 4,168,747 |
| 4,082,144 | 3,036,530 |
| 4,064,939 | 2,650,314 |
| | 4,282,523 |

These patents show various means of moving a logging tool in a borehole, such as in U.S. Pat. No. 2,650,314 which teaches the use of an electric motor supplied by power from a cable extending from the earth's surface, the electric motor rotating propeller type blades moves well fluid past the tool imparting a thrust to pull the cable with it. A more recent example of efforts to pull a cable in a borehole is illustrated in U.S. Pat. No. 4,113,236. This tool utilizes an internal pump. Fluid is drawn into the interior of the device and moved by an electrically operated pump to be expelled through fluid outlets in the rear of the device to provide a thrust to pull the cable. However, the prior art has not been applied successfully on a large scale commercial basis in the petroleum industry because of problems and limitations in the devices illustrated in these issued patents. The present disclosure, in addition to revealing improvements in the concepts exemplified by these prior issued patents, provides basic departures from known apparatus and techniques for moving well logging equipment down an inclined borehole.

SUMMARY OF THE INVENTION

The invention provides improved apparatus for transporting well logging equipment down a borehole having fluid therein. The apparatus, which may be termed a transporter, has a body which has a normal exterior diameter less than the interior diameter of the borehole. Means is provided for moving fluid through or past the body to cause the transporter to advance in the borehole. An important innovative feature of the invention is the provision of means of forming a cylinder-piston relationship between the borehole and the transporter body. The fluid moving means thereby creates a differential pressure in the fluid across the transporter, and this differential pressure functions to displace or move the transporter in the borehole.

In one arrangement the transporter has connected to it a cable extending to the earth's surface. An improved means is provided for transmitting electrical energy on a plurality of conductors within the cable while also providing means of utilizing such conductors for transfer of information between the earth's surface and the borehole and, contrarily, between the transporter and the earth's surface. Another important feature which distinguishes the present invention over the known prior art is the provision of means of reducing the possibility of the transporter becoming stuck in a borehole. Other features of the invention include means of detecting the movement of the transporter and transmitting this information to the earth's surface so that corrective action can be instigated to move the transporter forwardly if it has stopped for any reason. Other improvements include the provision of means of preventing twisting of a cable extending from the transporter to the earth's surface and for improved data gathering. An additional improvement is a means of constructing and operating a cableless transporter for well measuring and logging operations and for communicating between the earth's surface and a cableless transporter. A still further improvement is an embodiment in which the transporter is caused to rotate in the borehole to reduce the friction of longitudinal movement and including helix tread on the exterior of the body for positive axial advancement of the transporter body.

DESCRIPTION OF THE VIEWS

FIG. 1 is a cross-sectional view of one embodiment of a transporter according to this invention, shown positioned in a borehole having fluid therein and showing the arrangement wherein a piston relationship is formed between the transporter body and the borehole and means for producing a pressure differential across the formed piston relationship so as to cause the displacement of the transporter in the borehole.

FIG. 2 is a cross-sectional view showing an embodiment of the invention including an alternate means of forming a piston relationship between the transporter body and the wall of a borehole and showing an alternate means of moving fluid through the transporter body.

FIG. 3 is an additional alternate embodiment in the nature of an improvement over the arrangement of FIG. 2. In this embodiment flexible cups on the exterior peripheral surface of the transporter body are utilized to form a piston relationship with the borehole wall, and means is shown whereby the external peripheral diameter of the cups may be varied so that the cups may be expanded to form a piston relationship and contracted when it is desired to move the transporter body in the upward direction in the borehole.

Figure 13:
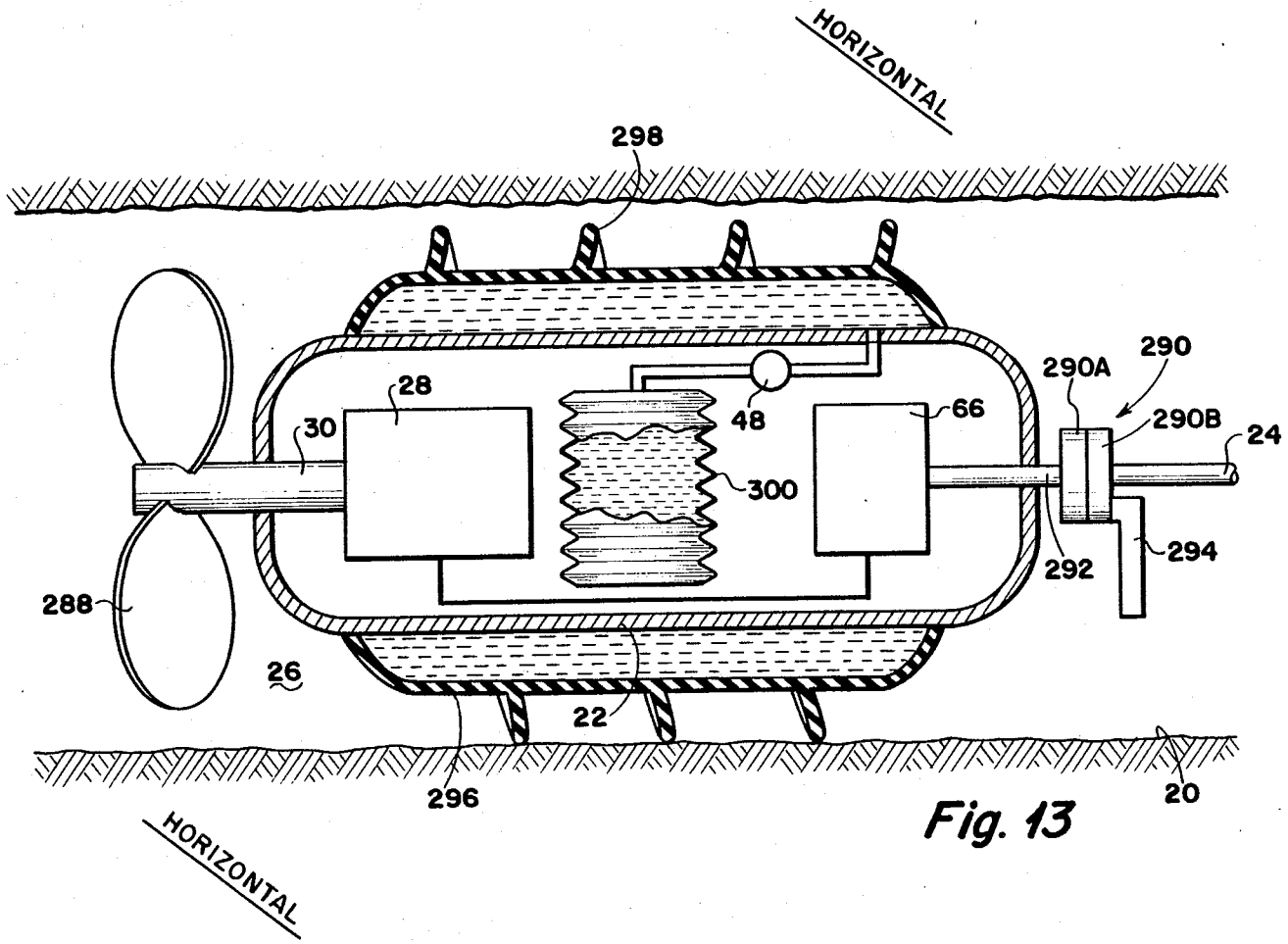

FIG. 13 is a cross-sectional view of a transporter having an expandable bladder on the body exterior. The transporter is propelled by a single propeller causing a rotational torque to be applied to the transporter body. A helical tread on the exterior of the expandable bladder assists in the forward advancement of the transporter.

Figure 14:
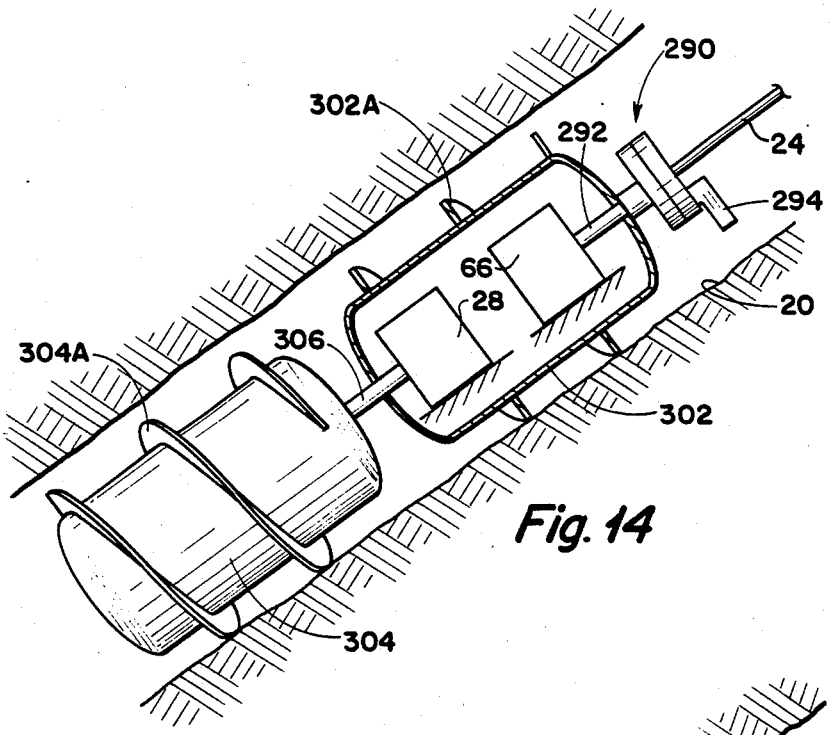

FIG. 14 is an elevational view shown partially in cross-section of a system in which the transporter is in the form of two portions rotatably connected end-to-end. Each portion has a helix on the exterior surface, the helix on the forward portion being oppositely oriented to the helix on the rearward portion and arranged so that the oppositely rotated portions causes the transporter to advance in the borehole.

Figure 15:
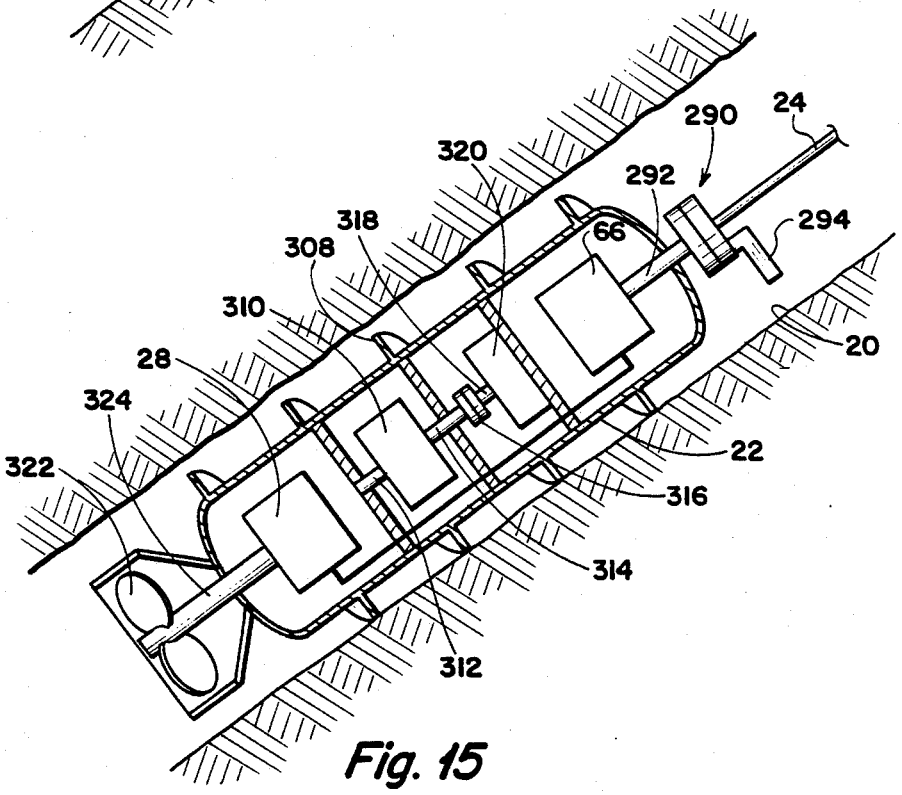

FIG. 15 is a cross-sectional illustration of a transporter system in which the body is caused to rotate by means of a motor acting in conjunction with a gyroscopic apparatus.

Figure 16:
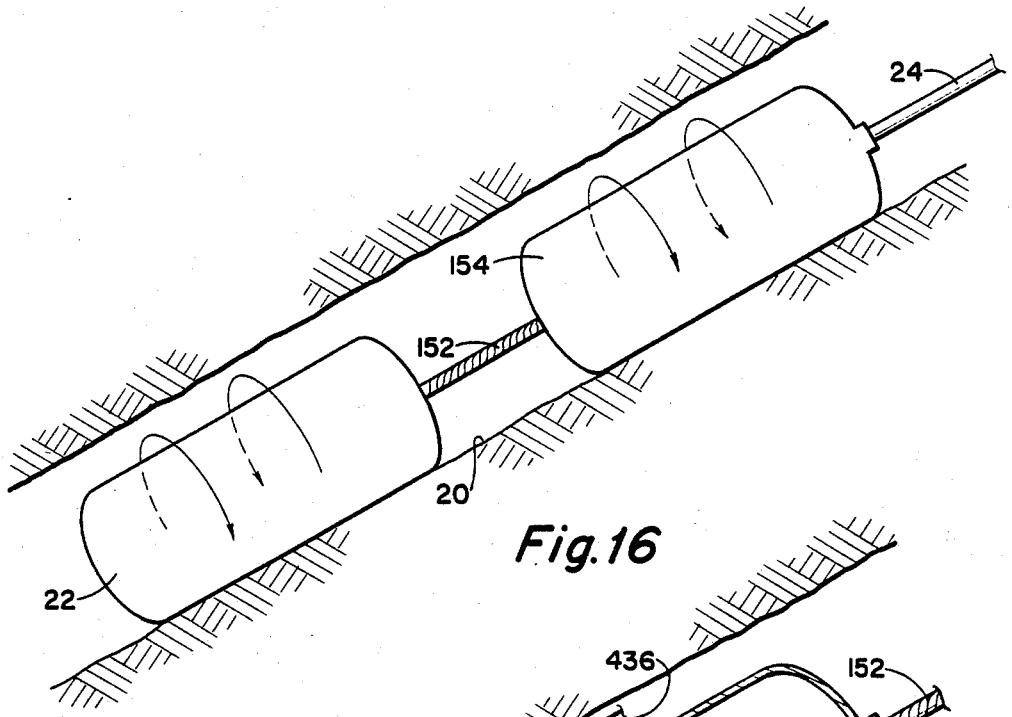

FIG. 16 is a diagramatic illustration of a transporter in an inclined borehole in which the transporter is in two sections, connected by cable, and arranged so that the sections rotate in opposite directions to substantially reduce the friction of the transporter against the borehole wall.

Figure 17:
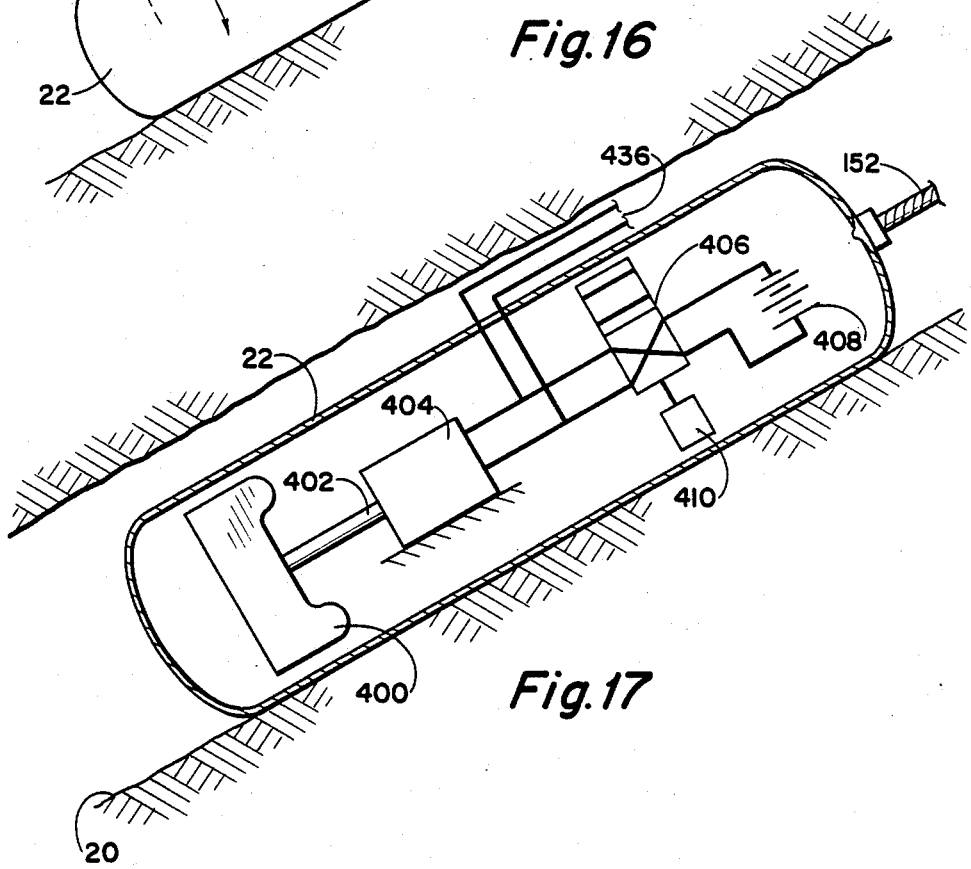

FIG. 17 is a schematic illustration of a means of rotating a transporter relative to the borehole in which a motor and a heavy flywheel are employed.

Figure 18:
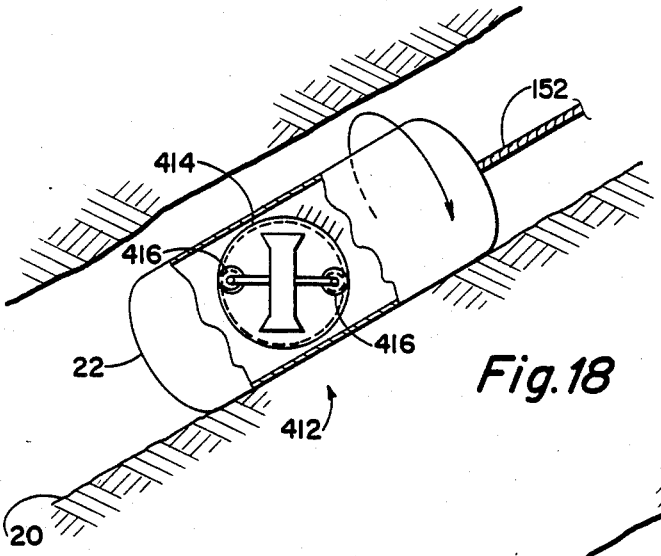

FIG. 18 is a diagramatic illustration of the use of a gyroscopic and gear arrangement for causing a transporter to rotate in a borehole.

Figure 19:
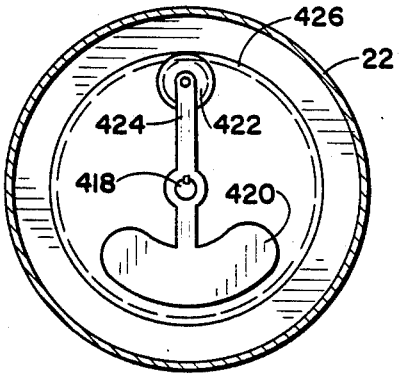

FIG. 19 is a cross-sectional diagramatic view of a portion of a transporter illustrating how an eccentric weight can be employed with a gear arrangement to cause the transporter body to rotate.

Figure 20:
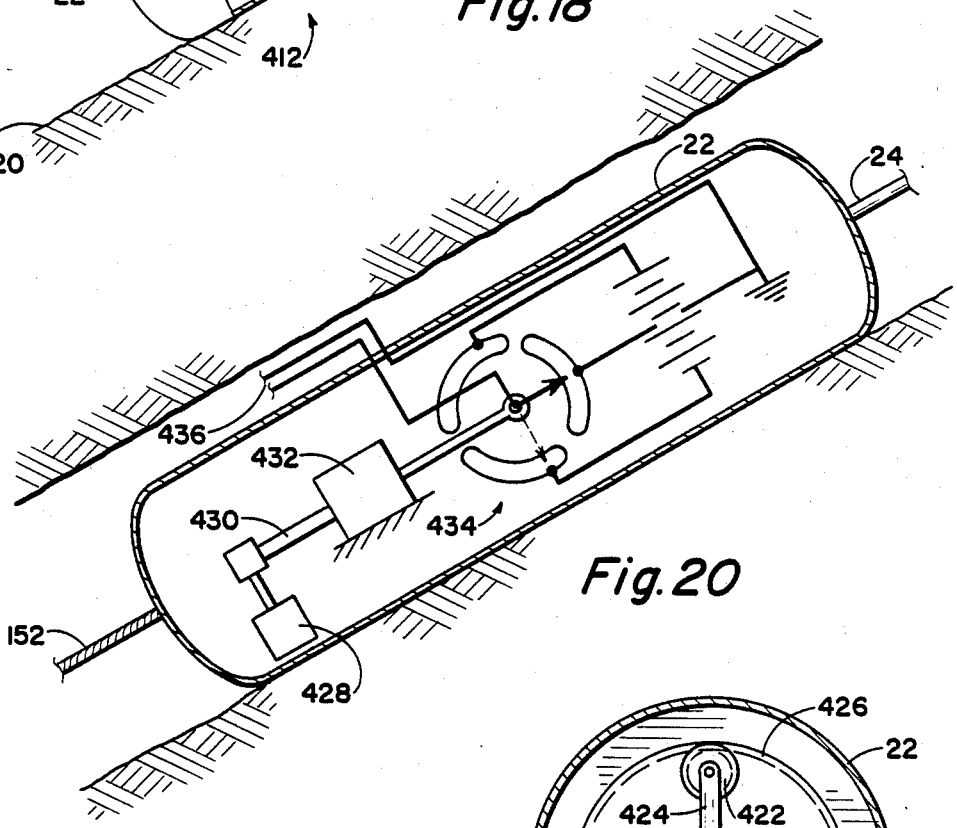

FIG. 20 is a schematic illustration of a transporter in which a switch arrangement is employed to cause the direction of rotation of the transporter to reverse after it has turned a selected number of turns in either direction.

DETAILED DESCRIPTION

Figure 1:
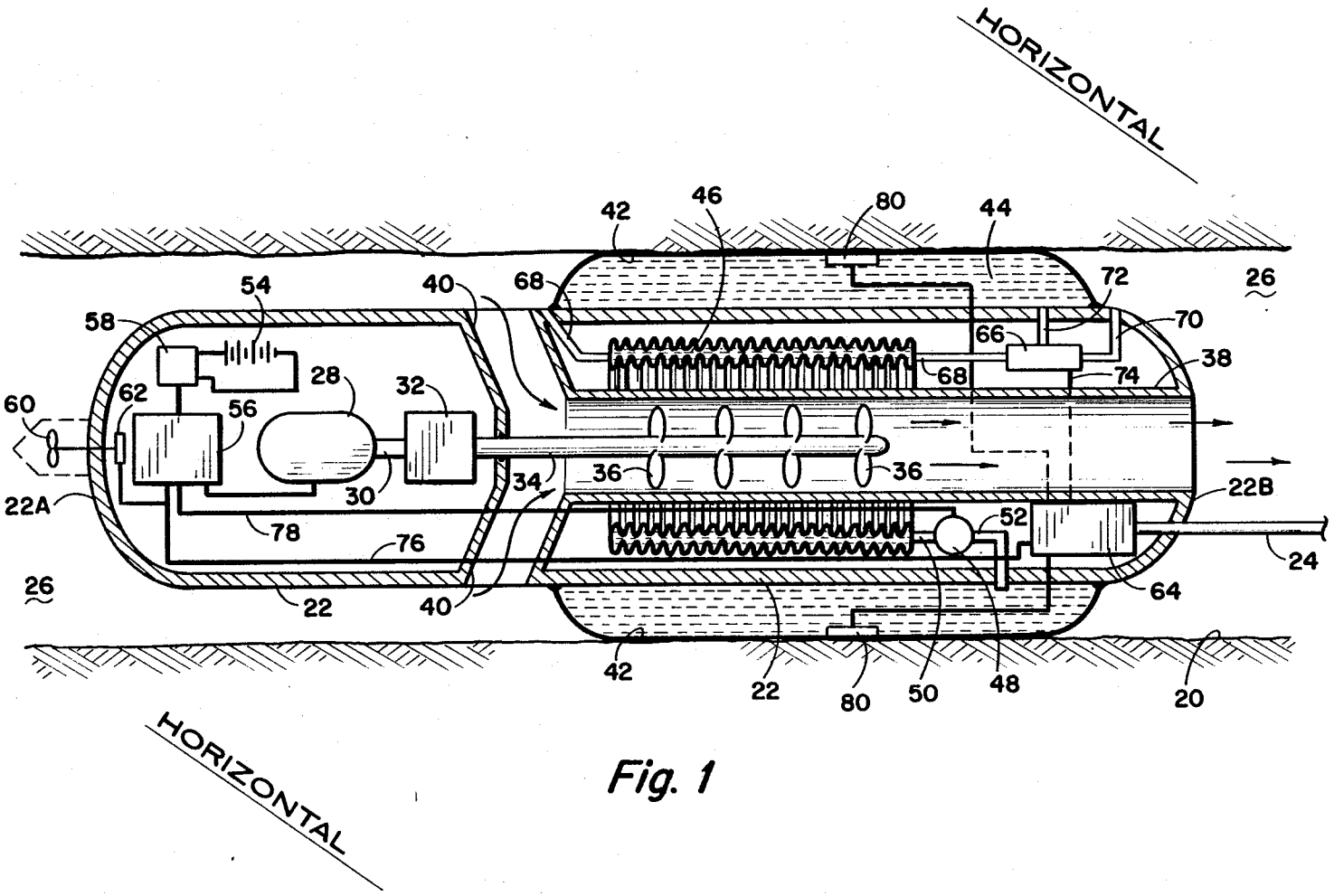

Referring first to FIG. 1, an embodiment of a transporter illustrating some of the principles of this invention is shown. The function of the transporter is to position well logging equipment at or near the bottom of a drill hole. As has been previously stated, when a drill hole is vertical or substantially vertical, logging tools can easily be lowered to the bottom of the hole by the use of a cable extending from the earth's surface. However, when the drill hole is inclined at an angle, the friction of the logging tool and the cable on the side of a hole frequently makes it impossible for the logging tool, by gravity alone, to reach the bottom of a drill hole. While others have suggested devices for transporting logging equipment in a borehole, such as in the previously issued U.S. patents above referenced, the devices have not been commercially employed to a significant extent and, therefore, the common means presently employed to move a well logging tool in a securely inclined drill hole is to run a string of drill pipe in the hole to push the logging tool to the bottom of the hole.

Figures 6, 7:
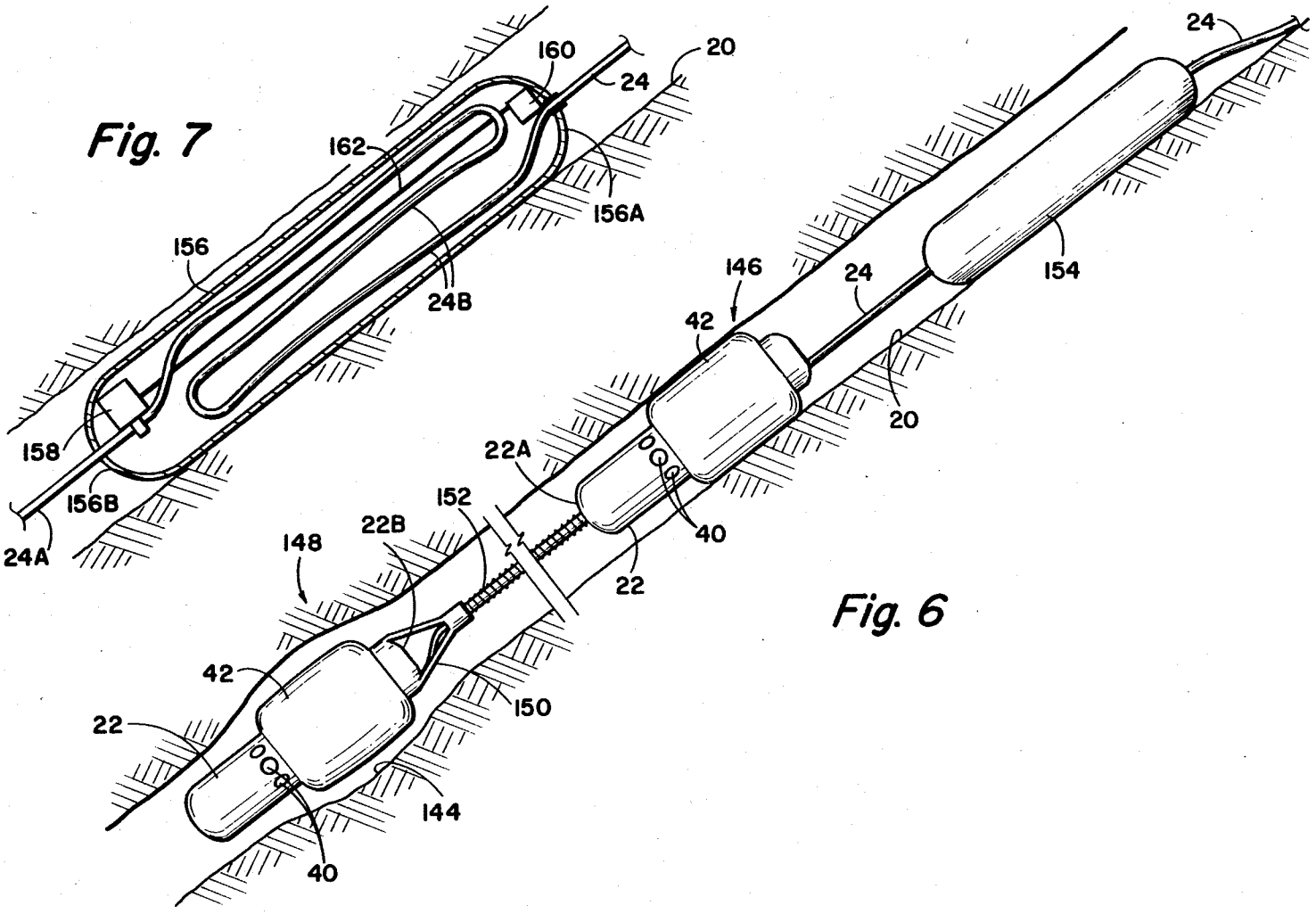
FIG. 6 is an illustration of one arrangement for minimizing the possibility that the transporter will be stuck in an inclined borehole by providing spaced apart transporter bodies connected by a flexible push-pull member.
FIG. 7 is an illustration of a means of reducing the risk of the transporter becoming stuck, including a device to vary the length of cable between the transporter and an instrument package or transporter and a cable extended to the surface so as to reduce the load on the transporter to minimum when necessary to pass a difficult spot in a borehole.

FIG. 1 illustrates a transporter for moving a logging tool and the cable by which it communicates to the surface, to the bottom of a borehole. A borehole inclined at an angle with respect to the vertical is indicated by the numeral 20, the borehole having been drilled from the earth's surface. A transporter body 22 is cylindrical and of an external diameter less than the borehole 20. Affixed to the body 22 is a cable 24 which may be attached to a well logging instrumentation package, such as illustrated in FIG. 6 which will be described in more detail subsequently, or the well logging instrumentation may be contained within body 22, in which case the cable 24 extends to the earth's surface. In any event, the function of the transporter is to pull cable 24 down to the bottom of an inclined borehole which, as is typical in the drilling and completion of an oil and gas well, is filled with drilling fluid 26.

Within transporter body 20 a motor 28 is provided, the motor having a drive shaft 30 connected to a gearbox 32, which in turn has an output shaft 34 which drives propellers 36. An internal conduit 38 within the body housing 22 is open at the body rearward end 22B for the expulsion of well fluid moved by propellers 36. Intermediate the ends of the body 22 are a plurality of fluid inlet openings 40. When propellers 36 are rotated, fluid is drawn in through openings 40 and expelled out the body rearward end 22B, thereby providing thrust for movement of the transporter in the borehole 20.

The transporter device described to this point is not significantly unlike others which have been proposed in the past, as illustrated in the prior issued United States patents previously referenced. A problem with the known devices is that it is difficult to achieve sufficient thrust to move a transporter body having attached to it a long length of cable in a well having a high degree of inclination or in which dog legs exist wherein the cable is pulled across one or more bends in the borehole. In order to significantly increase the force applied to move the transporter body 10, an important concept of this disclosure is a means provided to form a piston relationship with the borehole 20 so that thereby the transporter is moved as a result of pressure differential in addition to the effect of thrust of fluid expelled from the rearward end of the transporter body. One means of affecting the piston relationship with borehole 20 is illustrated in FIG. 1 and includes means of expanding the external diameter of the transporter. In the form illustrated in FIG. 1, this is accomplished by an expandable bladder 42. The bladder is affixed to the outer circumferential surface of transporter body 22 rearwardly of the fluid inlet openings 40 and may be formed of rubber or plastic type materials. The bladder 42 is expanded outwardly to form a piston relationship with borehole 20 by means of fluid 44 which may be gas or, preferably, liquid. Fluid 44 may be obtained from the well fluid 26 or, in the preferred and illustrated arrangement of FIG. 1, from a self-contained storage, such as an expandable reservoir 46. A small pump 48 is connected by a conduit 50 with the expandable reservoir 46 and by a second conduit 52 to the interior of the bladder 42. When pump 48 is actuated to drive fluid from within reservoir 46 to the interior of the bladder, the bladder is expanded outwardly so as to achieve the configuration illustrated in FIG. 1 in which the bladder engages or substantially engages the borehole 20, thereby forming a piston relationship with the borehole. When it is desired to retract bladder 42, such as when preparing the transporter to be pulled from within a borehole back to the earth's surface, pump 48 may be reversed, moving the fluid 44 from within the bladder back into the expandable reservoir 46. In another arrangement it can be seen that the bladder 42 may be of a resilient constrictive construction normally urging fluid to flow from within the bladder back into the reservoir so that instead of reversing pump 48 to move the fluid back, an electrically operated valve (not illustrated) may be opened when it is desired to collapse the bladder. In any event, by means contained within the transporter body 22, provision is made to selectively expand bladder 42 outwardly into a piston forming relationship, or to withdraw it to a decreased external diameter.

In a typical application of the invention, the transporter body 22 may be lowered by means of cable 42 in a borehole as long as gravity overcomes the friction imparted on the transporter, the instrumentation package, and the cable. When the friction exceeds the point wherein gravity will not move the transporter further, the bladder 42 may be expanded, causing a piston relationship with the borehole, after which the motor 28 may be energized to move liquid from below to above the transporter, causing a pressure differential which is applied across this piston relationship. This pressure differential will move the transporter downwardly.

In another mode of operation, the transporter, instrument package, and cable may be lowered as far as possible by the effect of gravity. Thereafter, the motor 28 may be energized, causing fluid thrust which will move the transporter, instrumentation package, and cable farther. If the thrust achieved by the expulsion of fluid from the rearward end of the transporter becomes insufficient to overcome friction so that the transporter stops or is moving at an insufficient rate, then the bladder may be expanded so that a piston relationship is established for more positive displacement of the transporter body in the borehole to ensure its movement to the desired depth.

The gearbox 32 may be of the type which automatically controls the rotational speed of output shaft 34 in proportion to the torque applied to the shaft so that when the resistance imposed by propellers 36 is slight, which will occur when fluid is easily moved through conduit 38, shaft 34 will rotate at a high rate of speed; but when high torque forces are required for rotation of the propellers 36, such as when more force is required to move fluid through conduit 38, the speed of rotation of shaft 34 is automatically reduced by gearbox 32 to reduce the speed of rotation and thereby limit the load applied to motor 28. Such automatic speed control gearboxes or torque converters are commercially available.

It can be seen that the force which can be applied to move the transporter of FIG. 1 employing a piston relationship with the borehole 20 is substantially greater than in the arrangement in which force is dependent only on the thrust generated by the movement of fluid past the transporter body. The force applied to the transporter body to move it in the borehole when a piston relationship exists is equal to the cross-sectional area of the borehole times the differential pressure across the transporter body. Assuming a borehole diameter of 10 inches, the cross-sectional area is approximately 78 square inches. Thus, a differential pressure of only 1 lb. will produce a force of 78 pounds to move the transporter with its attached instrumentation package and cable in the hole.

Power to supply energy for motor 28, pump 48, and instrumentation within the transporter may be supplied by self-contained battery 54 or by power supplied from the surface by means of cable 24 in a manner which will be described subsequently, or by a combination of both. Circuitry 56 is employed to control electrical power supplied to motor 28 in a manner which will be described in detail subsequently. The battery control circuitry 58 included within the transporter provides means whereby energy may be supplied by battery 54 as required, by which battery 54 may be charged from electrical energy supplied from the earth's surface.

In order to monitor the progress of a transporter in a borehole, it is important for the operator at the surface to know if the transporter becomes stuck. This information can be determined by means of a motion detector. One form of such motion detector is a small propeller 60 extending from the forward end 22A of a transporter body. The propeller is connected to a tachometer 62 providing a signal indicative of the speed of movement of the transporter through the well fluid 26. This speed of movement signal is conveyed to an instrumentation package 64 and, by way of cable 24, to the earth's surface. Other means of speed of movement detection include solid state devices encompassed within the instrumentation package 64 such as a motion detector and integrator. Such devices are known and commercially available.

In order for the operator at the earth's surface to monitor the performance of the transporter, it may be important to determine whether or not a pressure differential exists across the piston forming portion of the transporter body. For this purpose a pressure differential detector 66 is employed having one conduit 68 connected to the exterior of the transporter body forwardly of bladder 42 and a second conduit 70 communicating with the exterior of the body rearwardly of the bladder. Another option is a conduit 72 connected to the interior of the bladder. In this way a pressure differential signal may be provided to indicate the pressure difference on opposite ends of the bladder 42 or a signal may be derived indicative of the pressure within the bladder compared to the pressure of the well fluid 26. The latter signal may be employed in controlling the actuation of pump 48 so that only a preselected pressure of the bladder fluid 44 relative to the pressure of well fluid 26 is utilized. It can be seen that if the pressure of fluid 44 within the bladder 42 is too high compared to the well fluid pressure, the frictional engagement of the bladder with the borehole 22 would make it difficult to move the transporter. On the other hand, if the pressure of fluid 44 within the bladder is too low, an effective piston relationship is not obtained. The ratio of the bladder to the borehole fluid pressure can be controlled utilizing the signal from the differential pressure indicators 66. This signal is applied by way of conductor 74 to the instrumentation package 64. Control signals pass from the instrumentation package 64 by conductor 76 to the control board 56 and from thence by way of conductor 78 to pump 48.

An ancillary advantage of the employment of diaphragm 42 to achieve a piston relationship between the transporter and the borehole is that it affords means of securely impressing instrumentation against the walls of the borehole. Such instrumentation is indicated by the numeral 80. This well logging instrumentation may include radio activity detectors, conductivity detectors, etc. When the bladder 42 is expanded outwardly into engagement with the borehole 20, it automatically carries with it the detectors 80 to effectively couple them in close proximity and, if required, into contact with the wall of the borehole so that improved measurements may be obtained.

Figure 2:
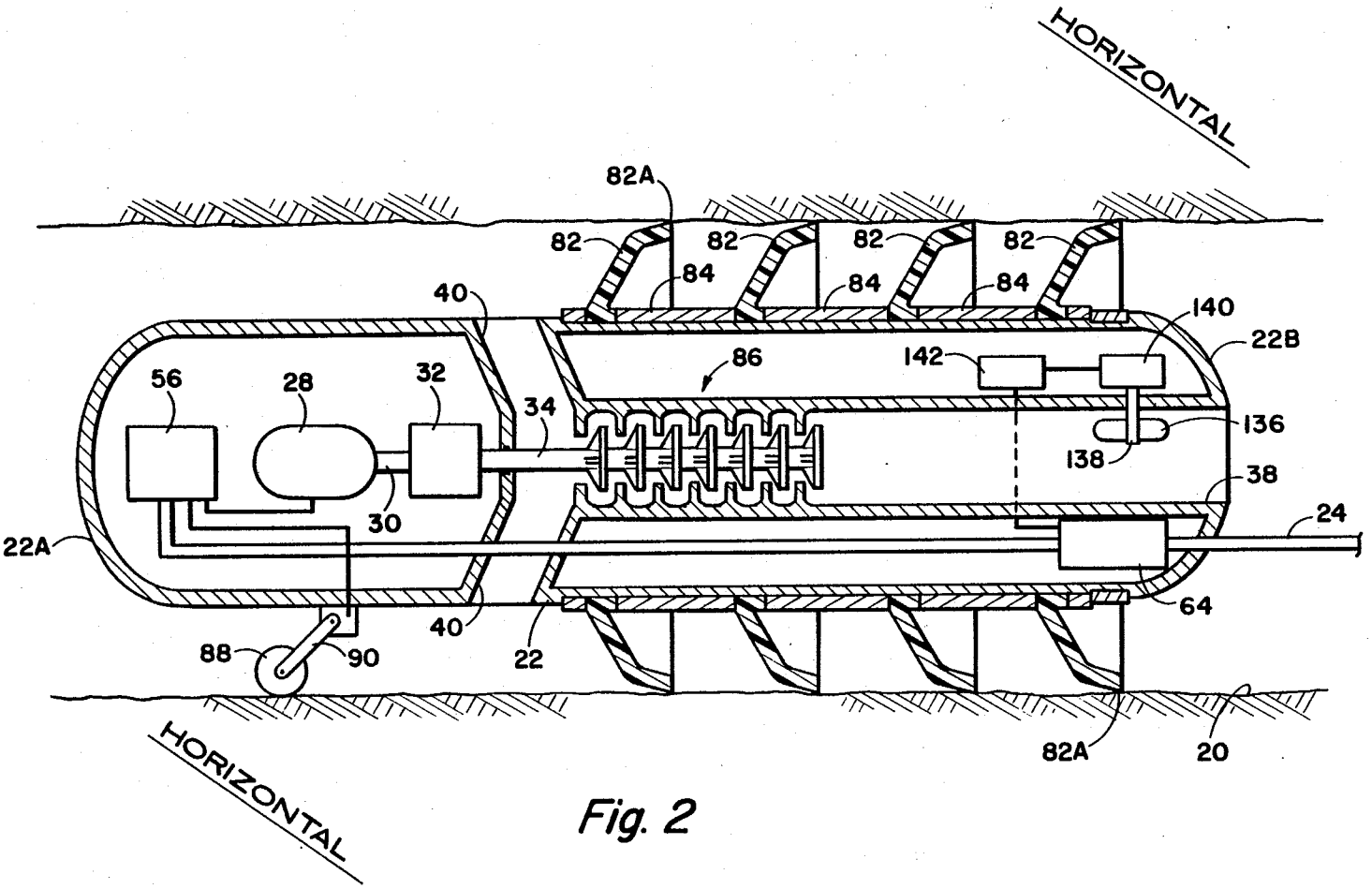

FIG. 2 shows an alternate embodiment of the invention. In this arrangement a piston relationship is established with borehole 20 by means of a series of circumferential spaced apart flexible cups 82. Each of the cups 82 has an outer peripheral surface 82A which is of external diameter substantially equal to the internal diameter of borehole 20. Each cup is preferably configured to be rearwardly inclined as illustrated, that is, it tapers from its inner end engagement with the transporter body 22 rearwardly to peripheral edge 82A so that each cup is disposed to move forwardly and downwardly in the borehole. The cups 82 are retained on the exterior surface of the transporter body in a manner similar to the retention of cups on a bottom hole pump or on a pipeline pig, both of which are well known in the petroleum industry. Spacers 84 are employed between the cups. In some instances, spacers 84 may also serve to help clamp or otherwise retain the cups in position on the transporter body exterior.

It can be seen that the cups function to provide a piston relationship so that differential pressure across the transporter will cause the transporter body to move in the borehole. When it is required to retract the transporter from the borehole by upward pull on cable 24, the resiliency of the cups will permit such upward movement and, if desirable, the cups 82 may be configured and constructed of material having sufficient flexibility so that upward pull on cable 24 will serve to reverse the cups as they engage the borehole sidewall so that the cups in effect extend in the direction opposite that shown in FIG. 2 as the transporter is being pulled out of a borehole.

FIG. 2 illustrates the use of a different type of pump compared to that of FIG. 1. In FIG. 2 the pump is illustrated as a jet or centrifugal type pump 86, a type of pump frequently employed in water wells or the like and which is capable of moving fairly large volumes of fluid. The pump 86 is illustrated as being of a multi-stage type, and obviously a few or many stages may be employed as necessary for moving fluid through ports 40 and out the rearward end of conduit 38 to provide thrust to move the transporter body 20.

A movement detector of a different type is illustrated in FIG. 2 in which a wheel 88 is supported at the outer end of an arm 90. Wheel 84 is arranged to engage the sidewall of borehole 20. Arm 90 may be resiliently outwardly biased so that the wheel 88 is at all times in engagement with the sidewall. By means of a tachometer, such as a magnet (not shown) affixed adjacent the wheel periphery which actuates a switch upon each revolution of the wheel, not only can the fact of movement of the transporter be detected, but also the speed of movement be given, which information is first conducted to the control circuitry 56 and thence, by way of cable 24, to the earth's surface.

In the embodiment of FIG. 2, cups 82 are affixed permanently to the exterior peripheral surface of the transporter body 22. The engagement of the peripheral surfaces 82A of the cups with the wall 20 will interpose some frictional impedance on the movement of the transporter so that it will be moved downwardly within a borehole by gravity on a much restricted basis compared to the embodiment of FIG. 1 when the bladder 42 is deflated. This impedance can be overcome by the use of pump 86. Further, the cups 82 will impose some restriction on the upward movement of the transporter out of the borehole, as upward force is applied by the cable 24. This can be overcome, to some extent, by arranging the cups so that upon sufficient upward force the cups will reverse themselves so that the outer portions are inclined in the direction towards the body forward end 22A, as previously mentioned.

Figure 3:
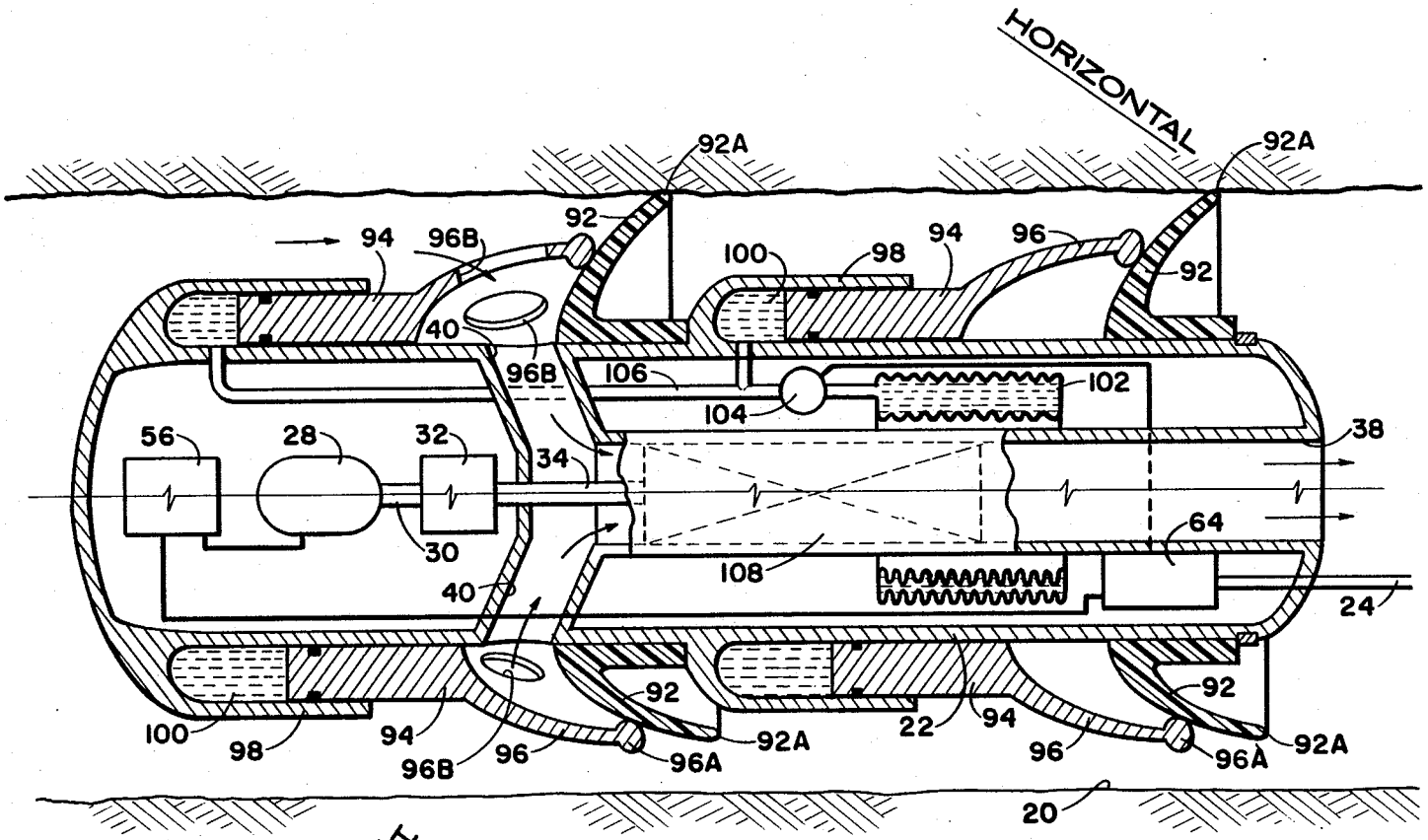

In FIG. 3, two cups 92 are shown affixed to the external peripheral surface of the transporter body 22. Cups 92 are dimensioned such that in their normal, outwardly extended configuration the peripheral surfaces 92A engage the borehole sidewall 20, as does the cups 82 of FIG. 2. Thus, in this condition, the cups form a piston relationship with the borehole, and differential pressure across the transporter accomplished by moving well fluid through the conduit 38 causes the transporter to travel in the borehole. When it is desirable to have the peripheral surfaces 92A of the cups retracted so as not to normally engage the borehole sidewall 20, the embodiment of FIG. 3 provides cup retracting means. This is illustrated in the form of annular hydraulic actuating devices including annular pistons 94. The pistons each have, at their rearward circumferential end thereof, outwardly extending integral bell-shaped flange portions 96. The outer ends 96A of each flange portion engages a cup 92 at a circumferential area intermediate the cup inner portion which engages the transporter body 22 and the outer peripheral surface. Formed on the exterior of the transporter body are two circumferential annular cylinders 98, each of which slidably receives an annular piston 94. Hydraulic fluid 100 is contained in each of the cylinders 98.

Within the transporter is a hydraulic fluid reservoir 102 which, as illustrated, may be of a collapsible type. Connected to reservoir 102 is a fluid pump 104 which in turn has a conduit 106 extending therefrom. Each of the hydraulic cylinders is connected with conduit 106 so that by means of pump 104 fluid may be moved into or out of the cylinders to thereby axially displace pistons 94.

In FIG. 3 the drawing illustrates the transporter in cross-section divided in a plane along the body longitudinal axis. The top portion of the drawing illustrates the transporter with pistons 94 in withdrawn positions allowing the elastomeric cups 92 to be outwardly extended wherein the peripheral circumferential edges 92A engage borehole sidewall 20. The lower portion of the drawing of FIG. 3 shows the annular pistons 94 in their outwardly advanced positions as occurs when, by means of pump 104, fluid is injected into the cylinders. As the pistons 94 are forced outward by the pressure of fluid 100 in cylinders 98, the outer ends 96A of the flange portions engage the cups 92 and compress them inwardly as shown in the bottom half of the drawing of FIG. 3. In this manner the diameter of the cup's peripheral surface 98A is reduced so that it is less than the internal diameter of borehole 20. In this manner the total external diameter of the transporter is less than that of the borehole so that when the transporter is entering a borehole and the effects of gravity on the transporter, instrumentation package, and cable are sufficient to overcome friction of these elements against the wall of the borehole, the transporter will move downwardly without requiring other motive force. In addition, in the retracted position of the cups the transporter can easily be withdrawn from within the borehole by upward pull on cable 24. Signals initiated at the earth's surface and conveyed by cable 24 can be employed to actuate pump 104. Pump 104 may be reversible, so that in one direction of rotation fluid is pumped from the reservoir 102 into cylinders 98 to extend the pistons 94 to collapse the cups 92; and when the pump is reversed, fluid is moved from within the cylinders back into the reservoir to withdraw the pistons and allow the cups to expand. It can be seen that rather than use of a reversible pump, spring means (not illustrated) could be employed to maintain the pistons in either the extended or retracted position and the pump utilized to move them to the other position.

In the illustrated arrangement of FIG. 3, the forward piston 94 is in front of the fluid inlet openings 40. For this reason, openings 96B must be formed in the piston flange portions 96 to provide a channel for fluid flowing through the internal conduit 38 as moved by a pump 108. In this figure the pump is indicated diagrammatically and, as previously indicated, may be of a variety of types. Whereas in FIG. 1 a propeller type fluid moving system is illustrated and in FIG. 2 a centrifugal type pump is shown, it can be seen that any type pump using energy supplied by an electric motor may be employed such as a Moyno pump as manufactured by Robbins Meyers Co.

Figure 4:
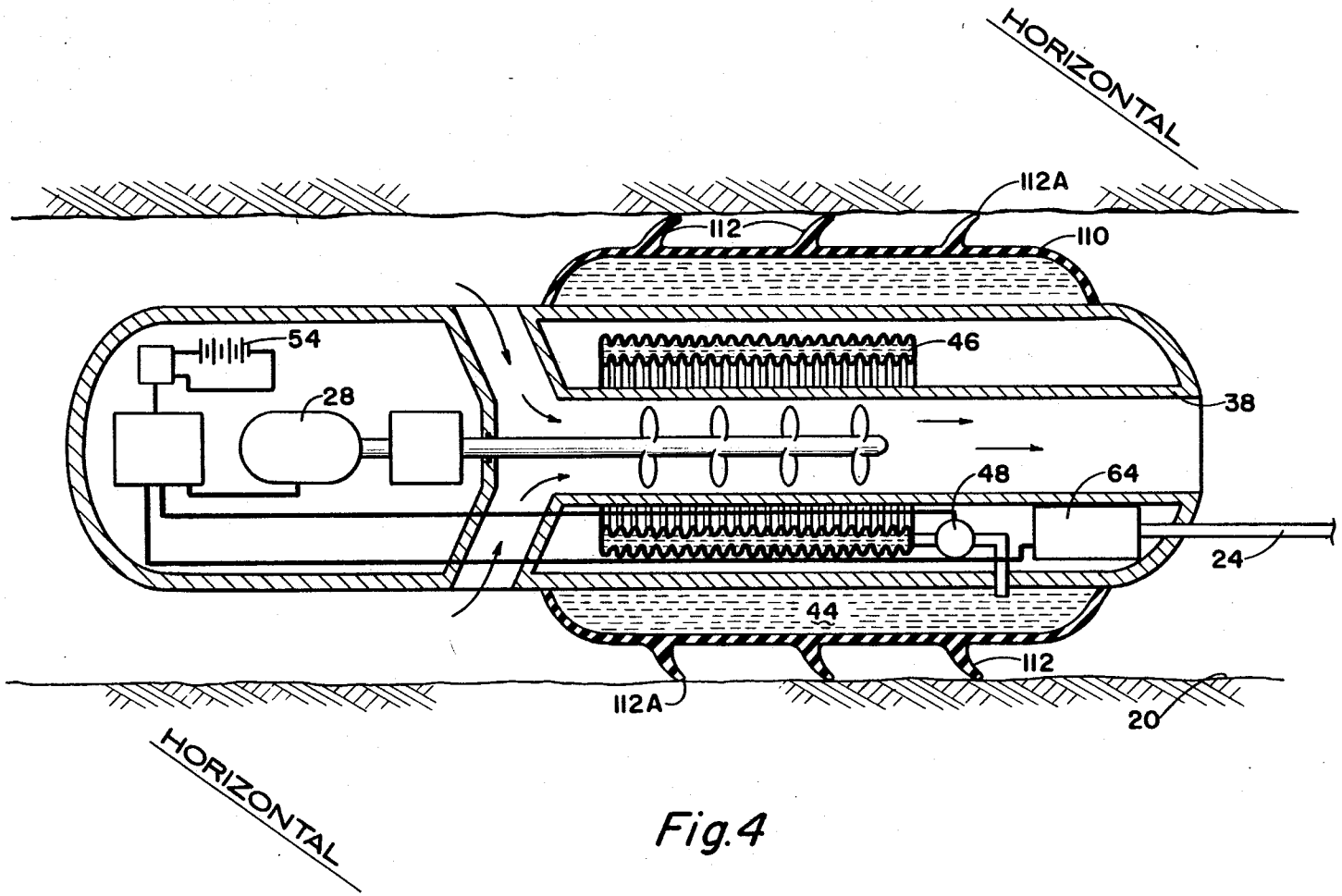
FIG. 4 is a cross-sectional view showing the arrangement wherein the means of forming a piston relationship with the borehole is accomplished by an expandable bladder having cups formed on the exterior circumferential surface.

FIG. 4 shows another alternate embodiment of the invention employing a type of bladder 110 which, unlike that of FIG. 1, has cup portions 112 on the external surface. The cups 112 are preferably integrally formed with the bladder 110 although obviously they could be otherwise attached to the exterior peripheral surface of the bladder. The cups are spaced apart from each other and circumferential. The bladder and cups are dimensioned so that when the bladder is outwardly expanded such as by means of pump 48 pumping fluid into the bladder from reservoir 46, the outer peripheral edges 112A slidably engage the borehole sidewall 20, forming a piston relationship with the borehole. When fluid 44 is withdrawn from bladder 110, such as by reversing pump 48 to move the fluid from within the bladder back into reservoir 46, the entire bladder is caused to collapse, thereby substantially decreasing the maximum external diameter of the transporter to facilitate lowering the transporter and cable in a well borehole when gravity is sufficient to overcome frictional restraints and to facilitate removing the transporter by upward pull on cable 24.

Figure 5:
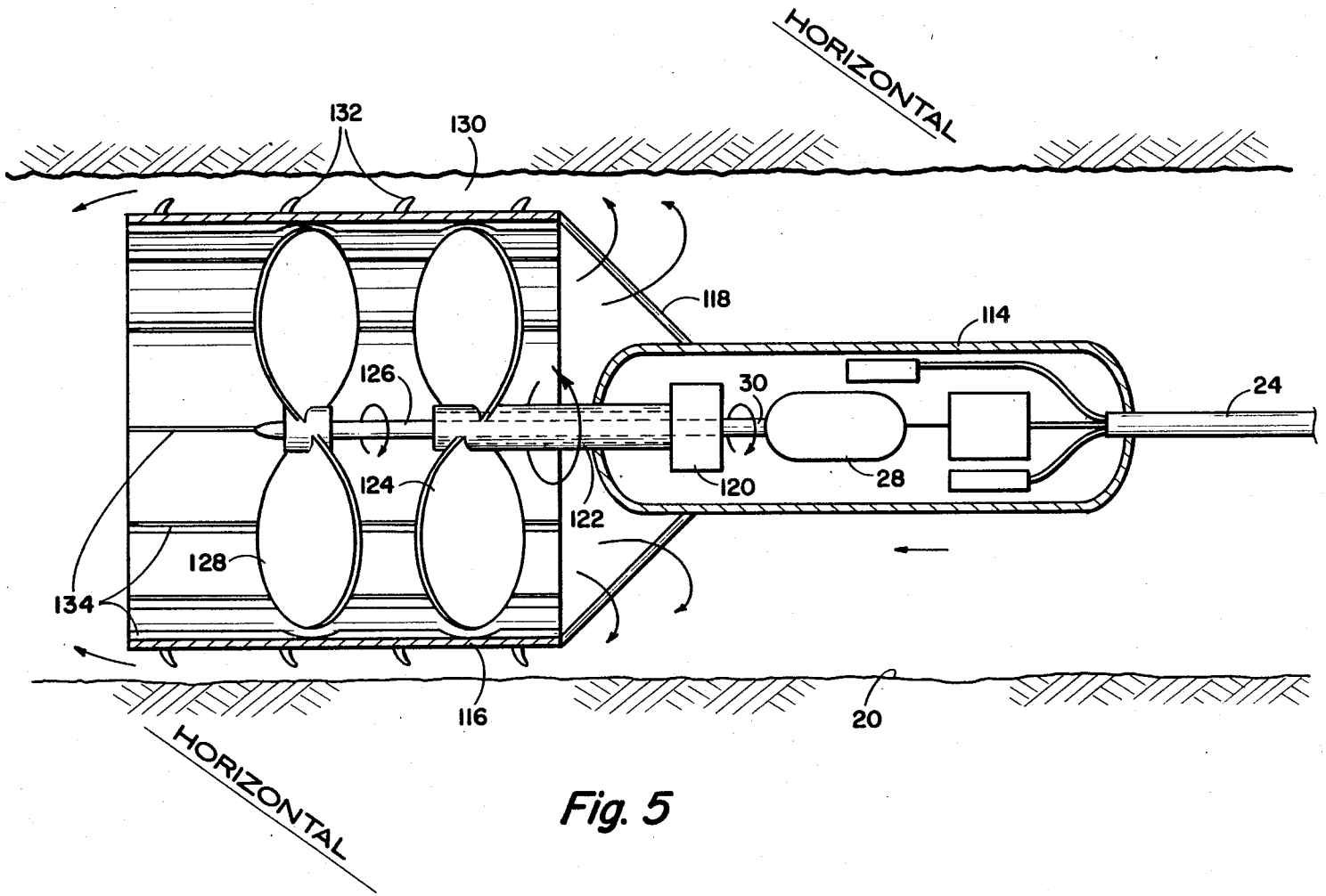
FIG. 5 is an additional alternate embodiment wherein the piston forming relationship of the transporter body and the borehole is achieved in a different manner, that is, by the provision of a portion of the transporter body of diameter substantially equal to the diameter of the borehole wall.

While FIGS. 1–4 illustrate various embodiments of expandable means for creating a piston relationship with a borehole to augment the movement of a transporter, FIG. 5 shows an alternate arrangement in which expandable means is not employed. In this embodiment a transporter body includes a shroud 116 of diameter substantially equal to the internal diameter of borehole 20. Shroud 116 is tubular and secured to the transporter body by spaced apart brackets 118. Motor 28 mounted within housing 114 has a drive shaft 30 connected to a gear drive unit 120 which in turn has two concentric drive shafts. The first drive shaft 122 is tubular and has connected to it a first propeller 124. The second drive shaft 126 is received within the tubular drive shaft 122 and receives a second propeller 128. Shafts 122 and 126 are turned in opposite directions by gear drive unit 120 so that the torque imposed on the transporter body 114 by the rotation of the propellers is counteracted. It is exceedingly important that the transporter functions in such a way that it does not rotate as it travels within the borehole. Otherwise, twist would be applied to cable 24.

When propellers 124 and 128 are rotated, fluid is moved through the shroud 116, causing a pressure differential to exist across the shroud, to thereby move the transporter within the borehole. Since the external diameter of shroud 116 is less than that of the borehole, some fluid will tend to flow in the opposite direction in the annular area 130, however, since this area is relatively small compared to the internal area of the shroud, a positive differential pressure is formed across the shroud to move the transporter. As an alternate arrangement, as shown in FIG. 5, the shroud may have on its exterior peripheral surface circumferential cups 132. These may be formed of resilient material and serve to impede the reverse flow of fluid in the annular space 130 to thereby provide more effective piston action of the shroud with the borehole 20.

As previously indicated, it is important that the transporter be propelled in such a way that no torque is created to rotate the device. To reduce possibility that the transporter would tend to rotate about its longitudinal axis when propellers 124 and 128 are rotated, vanes 134 may be placed on the internal surface of the shroud with notches cut in the vanes to receive the peripheries of the propellers.

For another means of ensuring that the transporter will not rotate about its longitudinal axis, refer to FIG. 2. Positioned within the conduit 38, through which fluid flows by the effect of pump 86, there is a vane 136 mounted on a shaft 138. The shaft is rotatably controlled by a servo motor 140 which in turn is controlled by a rotational sensor element 142. The vane 136 is an elongated thin member. If the transporter is operating in such a way that no torque is supplied, tending to rotate the transporter, the vane 136 is maintained so that the plane thereof is in the plane of the longitudinal axis of conduit 38. If, however, rotation is sensed by element 142, a corrective electrical signal is applied to servo motor 140 to rotate the shaft 138 and thereby vane 136 a few degrees. The vane then will be in a plane which is askew of the plane of conduit 38 longitudinal axis. This will cause a deflection of the fluid passing from the conduit 38 and thereby impart counteracting rotational torque to the transporter body. This counteracting torque can be regulated by sensor 142 so as to prevent the rotation of the transporter.

A problem which must be considered in the use of a transporter for moving well logging instrumentation is that of the possibility of the transporter becoming stuck in the borehole. In drilling boreholes in the earth, stratas of different characteristics are traversed. For instance, a strata of relatively soft material may exist between those of relatively hard material. Due to the jet action of the drilling mud flowing through the bit during the drilling process, enlarged cavities can occur in a borehole. Such cavities can be formed as, for example, when drilling operation is suspended for a length of time and the bit is in an area of relatively soft material, while circulation of drill mud is maintained. These cavities, or washouts, create areas of enlarged external diameter of the borehole and create pockets of discontinuity of the borehole configuration. An important aspect of this invention is the concept of creating a piston relationship between the transporter and the borehole. The embodiments of FIGS. 1–5 illustrate various means wherein this may be accomplished. However, when an area within the borehole is reached that has a diameter greater than the normal diameter of the borehole, the piston relationship may be destroyed. FIG. 6 illustrates an arrangement wherein this difficulty is circumvented.

An inclined borehole having an enlarged cavity 144 is illustrated. A first transporter is generally indicated by the numeral 146 and is illustrated to be of the type exemplified in FIG. 1, that is, having a body 22 and an externally expandable bladder 42. The bladder is shown expanded so that piston relationship is established with borehole 20. It can be seen that if single transporter 146 is employed and that propulsion of the transporter through the borehole is dependent upon the piston relationship and differential pressure established across the borehole to apply motive force, that such motive force will be substantially decreased or destroyed upon the encounter with the enlarged cavity 144. To provide for this eventuality, a second transporter generally indicated by the numeral 148 is provided which has a configuration also of the type shown in FIG. 1 with the exception that the rearward end 22B of the transporter body has a bracket 150 formed of two or more legs extending from it. Connected to bracket 150 is one end of a push-pull, semi-flexible member 152 which is connected at the other end to the forward end 22A of the first transporter 146. The push-pull member 152 couples the transporters 146 and 148 together in such a way that pulling force is exerted by transporter 148 on the first transporter 146, or pushing force may be applied by first transporter 146 against second transporter 148. The push-pull member 152 may be formed of a cable of the type employed to transmit steering force from a steering wheel to an outboard motor on a boat, that is, the cable 152 is flexible to bend around a relatively large radius but is, nevertheless, sufficiently stiff to apply pushing force from transporter 146 to 148. In the manner shown in FIG. 6, the piston relationship of transporter 148 with the borehole has been substantially reduced or destroyed by the occurrence of the enlarged cavity 144. However, by means of the push-pull member 152, the transporter 146 is spaced at a distance away from the transporter 148 so that it is not affected by the cavity 144, and the piston relationship is maintained so that it will push the second transporter 148 past the cavity. At the time when the transporter 146 encounters cavity 144 and its piston relationship is vitiated, transporter 148 will have entered a portion of the hole of normal diameter so that its piston relationship is re-established and fluid flow past it causes differential pressure, creating force to move it in the borehole and pull with it the transporter 146 past the cavity. Spacing between transporters 146 and 148 may be selected according to the diameter of the borehole to which the transporter is configured, with the longer spacing being required in proportion to the diameter of the borehole. However, a spacing of 3 or 4 feet up to 10 to 12 feet will normally be sufficient to significantly reduce the possibility that the transporters will be stopped by an enlarged cavity.

FIG. 6 shows cable 24 extending from the transporter 146 attached to an instrumentation package 154. Contained within the housing forming the instrumentation package are instruments utilized for making downhole measurements such as pressure indicators, inclinometers, gravitometers, and various radioactivity measuring instruments well known in the petroleum industry. The instrumentation desired for making measurements and logs in a borehole may be contained internally within the bodies of transporters 146 or 148 or they may be contained in a separate housing as illustrated in FIG. 6. One advantage of the arrangement of FIG. 6 is that the design and construction of the transporter is substantially simplified by including the instrumentation in a separate housing, and this is particularly true since instrumentation is presently designed for lowering on a wire line and is available without substantial change when employed in conjunction with the use of a transporter system.

Another means of reducing the possibility of a transporter becoming stuck, that is, unable to move itself and associated instrumentation package and cable down an inclined borehole, is illustrated in FIG. 7. It can be appreciated that the force necessary to move a transporter body within a borehole is very small compared to the total force required to move a transporter body plus instrumentation package if it is employed, plus, and most important, the long cable extending to the earth's surface. As a transporter moves down a borehole, it may move past one or more angular deviations in the borehole, and the cable pulled from the earth's surface thereby must be in contact with the borehole sidewall. When a borehole is drilled at a substantial angular deviation from the vertical, the mere weight of the cable lying against the borehole sidewall imposes substantial friction. When a transporter encounters an enlarged diameter area of the borehole in which the piston relationship is reduced or substantially destroyed, the force which can be imparted by the transporter may not be sufficient to pull a long length of cable even though the transporter would be capable of easily moving itself if the load of the cable did not exist. The arrangement of FIG. 7 provides a means of overcoming a situation in which an enlargement of the borehole diameter reduces the pulling power of the transporter but in which the transporter is permitted to pass the enlarged hole area without having, at the same time, to pull the cable with it. A housing 156 has a diameter less than that of the borehole and has attached to the rearward end 156A the cable 24 which either extends to the earth's surface or to an instrumentation package 154 such as shown in FIG. 6. Extending from the forward end 156B is a forward portion 24A of the cable which connects to the rearward end of a transporter (not shown). Contained within housing 156 are loops 24B of the cable. An electrically actuated cable release 158 is mounted within the housing and adjacent the forward end 156B. The cable release normally secures the cable so that the loop 24B is retained within the housing. A junction box 160 provides means for a conductor 162 to be brought from the cable to the cable release 158. If the transporter becomes stuck, that is, is not moving within the borehole, such movement can be detected by the operator on the earth's surface by means of the motion detectors previously described with reference to FIGS. 1 and 2. The operator, in order to unstick the transporter and permit it to move past a troublesome area in the borehole, may actuate the cable release 158. Upon actuation, cable portion 24A may be pulled from within housing 156. This means that the transporter then can move forwardly within the borehole for a substantial distance, depending on the amount of cable contained in the loops 24B, without having to pull with it housing 156 and an instrumentation package and/or the cable 24 extending from the rearward end of the housing 156. By the time the surplus cable contained in loops 24B has been pulled out of the housing 156, the transporter will have passed (in most instances) the troublesome area in the borehole so that the transporter will be in a position to again establish a piston relationship with the borehole and provide positive propulsion force to move the transporter forward.

Another means of assisting to dislodge a transporter if it becomes stuck in a borehole is the ability to reverse the direction of propulsion. For instance, in FIG. 5, motor 28 may be made reversible so that, by control from the earth's surface, the transporter can generate force to move itself in the upward as well as downward direction. The ability to reverse the direction of propulsion force will be particularly useful if the transporters should become stuck and upward pull on the cable 24 does not succeed in dislodging it. Reversing the direction of thrust can be used to assist the force applied by cable 24 to unstick a transporter in situations where it might otherwise become lodged in such a manner that the cable 24 could be broken before sufficient force is applied on the transporter to dislodge it.

Figure 8:
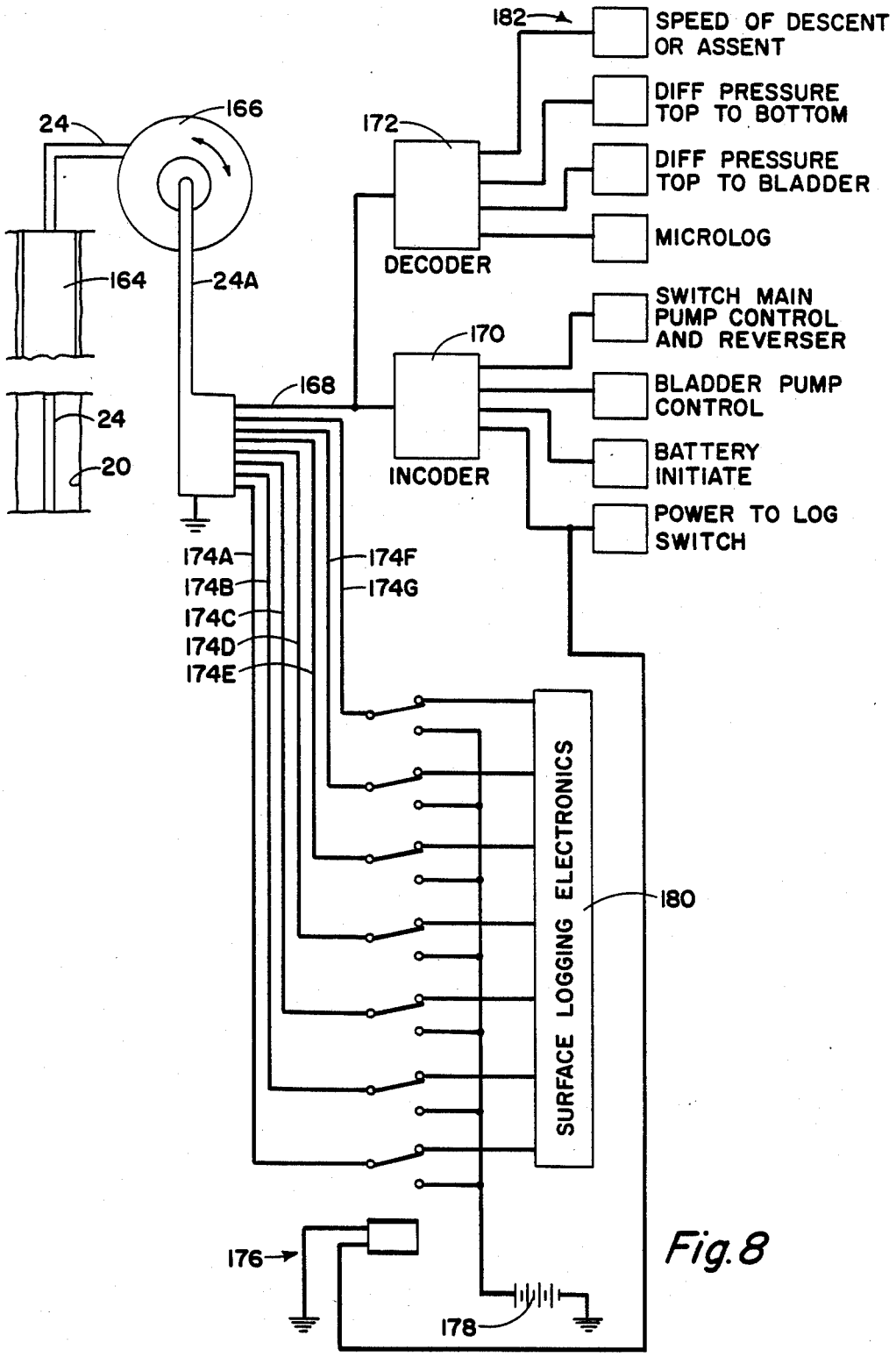
FIG. 8 is a schematic diagram of apparatus at the earth's surface to monitor and control a transporter and well logging equipment.

FIG. 8 diagrammatically illustrates surface equipment useful in conjunction with the transporter of this invention and particularly shows the arrangement wherein cable 24 may be employed not only for purposes of providing multiple conductors for transmission of measuring and logging signals but, in addition, for transmitting electrical energy from the surface to the transporter. A casing 164 extending into borehole 20 receives cable 24, the lower end of which (not shown) is attached to a transporter. The cable 24 is wound on a reel 166 by which it is lowered into or removed from the borehole. In the typical manner of using cable supported measuring and logging tools, the tool suspended on cable 24 is lowered into the borehole containing casing 164 connects and is pulled to the bottom of the borehole by gravity. When the borehole is inclined at a severe angle relative to the vertical, however, difficulty can be experienced in causing the logging tool to drop to the bottom of the borehole. For this purpose, as has been explained previously, a typical method of extending the measuring tool into the bottom of the borehole is use of a drill string which is exceedingly time consuming and expensive. By the use of the transporter of this invention, the cable 24 will be pulled downwardly within a borehole, regardless of a degree of inclination, so that the measuring and recording instruments can be moved to the bottom of the borehole, or at least to the desired depth where measuring and recording is to be made.

Reel 166 has slip-rings providing communication between each conductor making up the cable portions 24 and 24A. Cable 24A is shown as having eight conductors and a grounded shield. Conductor 168 is connected to an encoder 170 by which a plurality of different instructional signals may be transmitted from the earth's surface to the transporter. Conductor 168 is also connected to a decoder 172 by which various information relating to the transporter may be read out. By providing switched signals to the encoder 170, various operations of the transporter can be controlled from the earth's surface as indicated for each of the blocks. The "switch main pump control and reverser" functions to energize, with respect to FIG. 1, motor 28 to cause it to rotate propellers 36 to thereby move fluid through the conduit 38 providing thrust to move the transporter. The direction of fluid movement may be reversed by reversing motor 28 so that fluid is drawn into the conduit 38 and expelled through openings 40 in the body sidewall, which openings are inclined forwardly, so that reverse thrust is applied to the transporter. The "bladder pump control" provides a signal for actuation of the pump motor 48 for expanding or retracting bladder 42 to either create a piston relationship between the transporter and the borehole sidewall or to cancel such relation. The "battery initiate" control may be utilized to connect battery 54 to motor 28. This may be done when increased thrust is required to move the transporter past a difficult place in the borehole. Battery 54 may be connected in parallel with energy supplied by cable 24 to operate motor 28, or it may be placed in series to provide additional voltage for the operation of the motor according to the motor design. Such operation can be carried out even though the motor is temporarily overloaded for a limited period of time to obtain maximum possible thrust from the motor in order to assist in unsticking the transporter. The "power-to-log" is employed in changing the circuitry within the transporter when switching from a propulsion mode to a measuring and recording mode.

Conductors 174A through 174G connect to a double-throw, eight-pole relay generally indicated by the numeral 176. One pole of each gang of the relay is connected to a voltage source 178. When the relay is in the up position as illustrated, each of the conductors 174A through 174G is connected to a separate input-to-surface logging electronic apparatus 180 so that measurements and records can be made of information detected by subsurface measuring apparatus contained either within the transporter, or in an instrumentation package pulled into the borehole by the transporter. In the down position, opposite that shown in FIG. 8, all of the conductors 174A through 174G are connected in parallel and to voltage source 178.

In order to monitor the performance of the transporter, it is important that information be provided to the operator at the earth's surface. This information can be delivered by way of encoded signals over conductor 168. The signals are decoded and fed to indicators 182. Comparing FIG. 8 with FIGS. 1 and 9, the "speed of ascent or descent" is obtained from the tachometer 62 operated by propeller 60 which responds to movement of the transporter through the well fluid. This enables the surface operator to determine the rate of movement of the transporter within the well and, in addition, indicates when the transporter stops. When this occurs, corrective action to unstick the transporter utilizing techniques and system previously discussed can be initiated by the operator. In addition to indicating the speed of descent, the propellers 62 and tachometer 60 may relay to instrumentation 182 speed of the ascent so that when upward pull is exerted on cable 24, such as to unstick a transporter or to otherwise move it within the borehole back towards the earth's surface, the operator can immediately determine when the transporter begins to move. Due to the long length of cable 24, stretch occurs and by indicating ascent of the transporter, the operator is better able to judge the amount of tension which may be placed on the cable before the limits of the cable are attained. Thus the speed of descent and ascent provides exceedingly valuable information to the surface operator.

Again referring to FIG. 1, the pressure differential detector 66 provides signals to the instrumentation package 64, which includes encoder 186. At the surface the signals are decoded and displayed as a part of the indicators 182. This information includes the differential pressure between the top and bottom of the transporter, that is, the differential pressure across the piston formed by the transporter with the borehole wall, as by the differential pressure in conduit 68 and 70. This information is used to indicate to the operator the performance of the motor and pump. If the transporter stops moving, the failure could be internally within the transporter, that is, the failure of motor 20 or pump 36. If this failure occurs, then there will be no differential pressure from the top to bottom of the transducer. On the other hand, if the transporter is not moving and differential pressure is indicated, it means that the motor and pump are working satisfactorily but that the transporter is stuck for some other reason, thereby enabling the operator to take corrective action. The same applies to the differential pressure from the top of the transporter to the bladder as indicated by pressure differences between conduits 72 and 70. The operator can utilize this information to control pump 48 to increase or decrease the bladder pressure in order to achieve the maximum rate of movement of the transporter in the well or to assist in unsticking the transporter if it stops moving for some reason. The indicator entitled "MICROLOG" provides a method of conveying to the surface measurements made such as by detectors 80 carried by the transporter itself as contrasted with downhole measurements made by a separate instrument package such as element 154 in FIG. 6.

Figure 9:
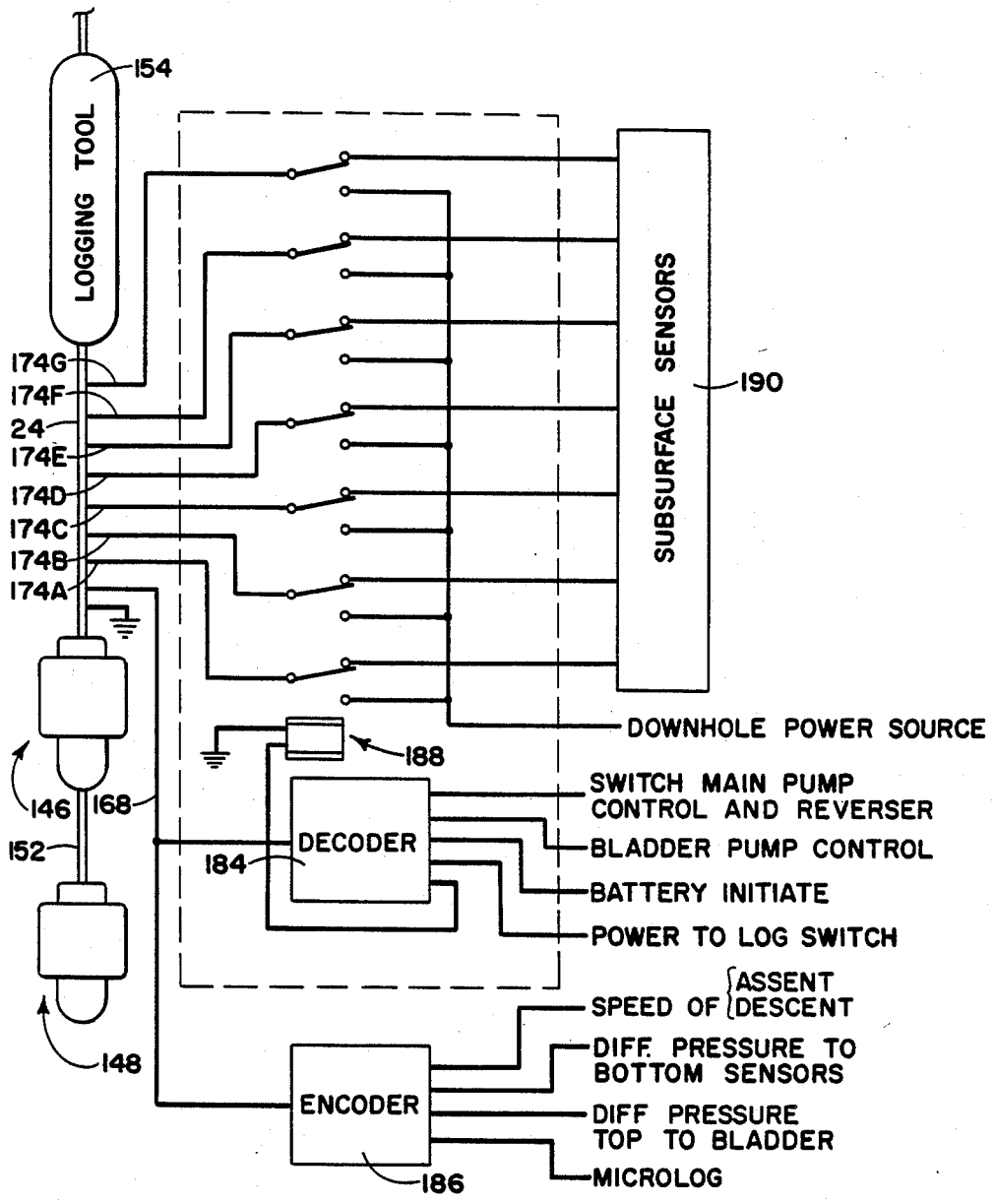
FIG. 9 is a schematic diagram of apparatus within the transporter and/or well logging instrument package as employed in practicing the invention.

The downhole circuitry of FIG. 9 is the complement of the uphole circuitry of FIG. 8. Conductor 168 extends to a downhole decoder 184 and an encoder 186. The decoder applies signals from the earth's surface to operation of controls in the transporter, such as: (a) to actuate the main pump to exert a thrust or differential pressure across the transporter, (b) to energize the bladder pump control, (c) to turn on the battery initiate, or (d) to cause the conversion of the cable from the function of supplying power to that of providing measuring and logging information. In like manner, the signal information indicative of the condition and performance of the transporter are impressed upon encoder 186, which information is delivered to the earth's surface for the benefit of the operator as previously discussed.

When cable 24 is to be used for supplying power to the transporter, in which conductors 174A through 174G are placed in parallel, the action of the multi-gang, two position relay 176 at the surface is duplicated by relay 188 in the transporter. In FIG. 9, relay 188 is in the up position wherein subsurface sensors 190 provide information on seven separate conductors which are connected to the surface logging electronics 180. These subsurface sensors are the standard type employed in cable operated well logging equipment, well known in the industry.

The transporters illustrated in FIGS. 1–6 employed to transport measuring and logging instruments and cable 24 affixed thereto from the earth's surface can be employed regardless of the type of cable utilized. However, if the cable is of light weight the load imposed on the transporter in moving a long length of cable through a crooked or severely inclined borehole will be reduced. There is available on the market a lightweight cable for use in boreholes arranged so that the total weight is not substantially greater than the volume of well fluid the cable displaces; that is, the cable is substantially weightless in the well fluid. By the use of such lightweight, or "weightless" cable, the amount of energy required by the transporter can be substantially reduced, thereby reducing the amount of thrust or motivating force required for propulsion of the transporter in a borehole. With the use of lightweight or "weightless" cable, in many instances it will be possible to provide sufficient force to move the logging tool through most inclined well situations by means of the internally contained battery 54, such as illustrated in FIGS. 1 and 4, and useful in the other embodiments, thereby simplifying the circuitry and switching operations between the surface equipment and the well logging equipment and the transporter.

Figure 10:
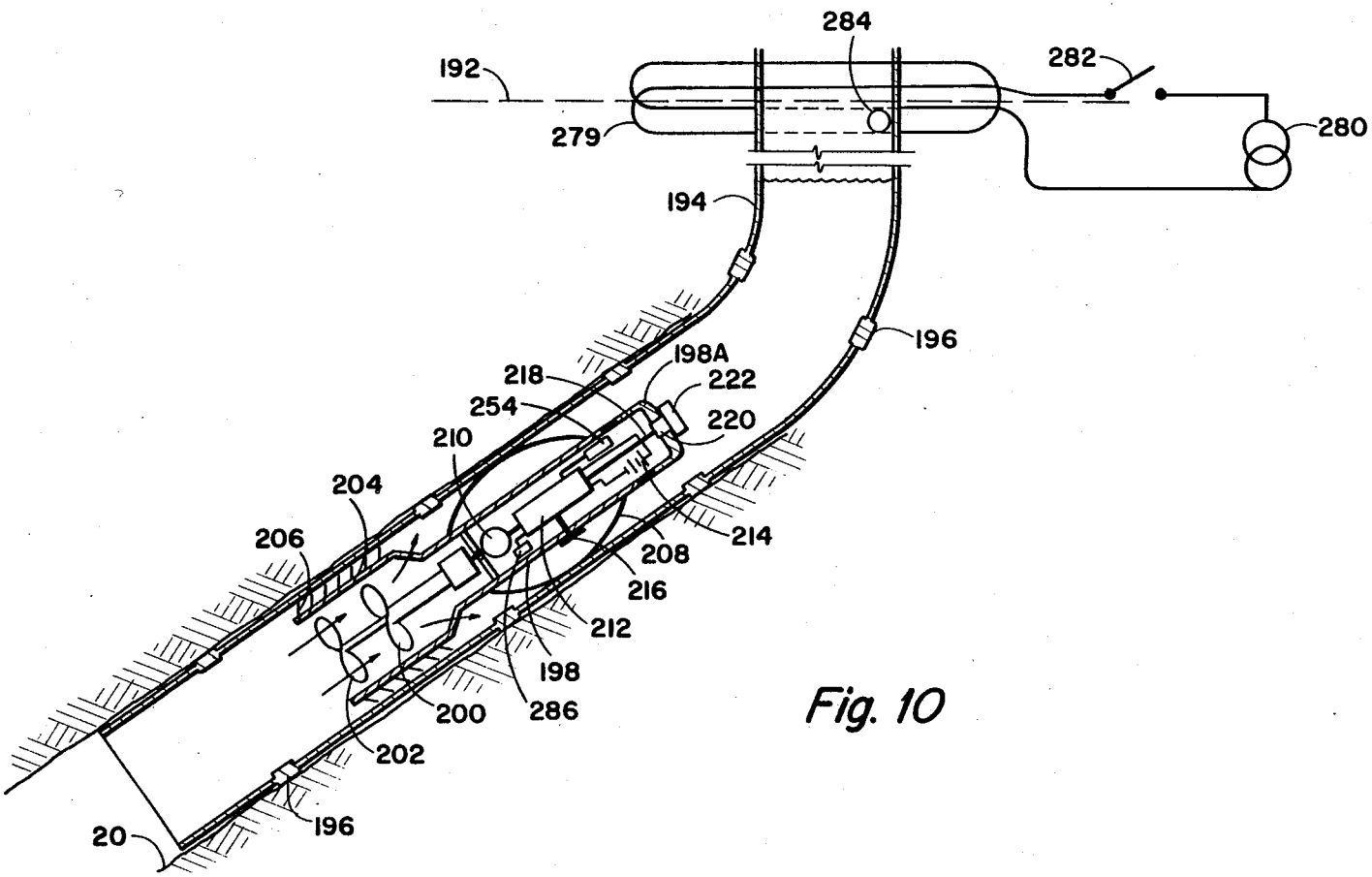
FIG. 10 is an elevational cross-sectional diagrammatic view of a borehole showing a cableless logging tool therein and showing the use of a low-frequency generator at the earth's surface for providing communication with the logging tool.

Referring to FIG. 10, an example of the application of this invention to a method and apparatus for logging a borehole by means of a cableless tool is illustrated. Extending from the surface of the earth 192 is a casing 194 positioned in a borehole 20. As is the frequent practice in drilling oil and gas wells, particularly from drilling platforms or on surface location wherein the area in which the drilling rig can be located is limited but wherein the potential for producing wells at locations which are displaced from the vertical exist, the borehole 20 extends vertically to a preselected depth and then is drilled in an inclined direction. As previously discussed, the transporter is particularly useful in assuring the movement of well measuring and logging equipment in such inclined boreholes. The apparatus in FIG. 10 is useful not only for inclined boreholes but also for making downhole measurements and acquiring information for producing logs without the use of a cable whether the borehole is inclined or vertical.

Casing 194 is formed of lengths of pipe connected together by collars 196. By detecting the collars, the depth of the instrument within the well can be carefully correlated since the length of each portion of the casing is known.

FIG. 10 shows a transporter body 198 providing an interior which is sealed from the entrance of well fluids. The transporter body includes a propulsion means such as the use of reverse rotating propellers 200 and 202 operating in a shroud 204 as has been described in detail with reference to FIG. 5. The shroud may include circumferential cups 206 to assist in forming a piston relationship with the interior of the casing 194 or the borehole 20. To stabilize the transporter body 196, three or more spaced apart flexible bow springs 208 may be employed.

The forward portion 198A of the transporter body may be threaded to the rearward portion to provide access to the interior of the transporter. In the assembled condition the body is leakproof. Contained within transporter 198 is motor 210 with the shaft therefrom extending exteriorally of the sealed portion of the transporter body housing to drive propellers 200 and 202. In the housing is an electronic package 212 and a battery 214. A sensor 216 is secured to the housing 198 and connected to the electronic package. Sensor 216 is emblematic of a plurality of various sensing and measuring apparatus which may be contained either within or exteriorally of the housing. The electronic package 212 has a cable 218 extending to a multi-connector plug 220 which has a removable waterproof cover 222.

Figures 11, 12:
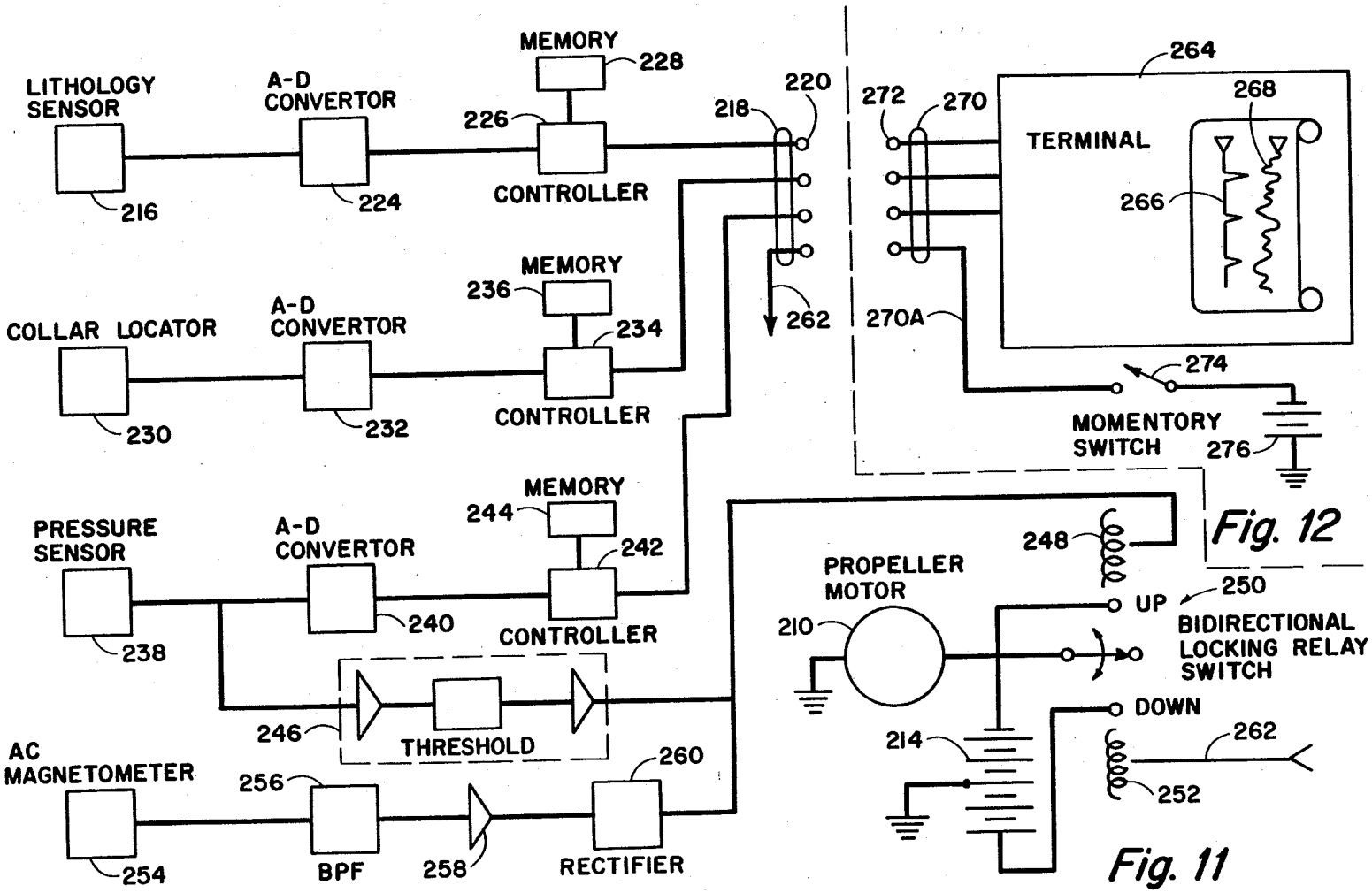
FIG. 11 is a schematic diagram of apparatus in the cableless logging tool of FIG. 10, including means by which the logging tool can be controlled from the earth's surface.
FIG. 12 is a schematic diagram of equipment at the earth's surface for use with the logging tool schematic of FIG. 11.

FIG. 11 illustrates circuitry contained within the transporter body 198. Battery 214 must have a high capacity such as a lithium inorganic type battery commercially available. A battery having the capacity to provide 10 to 20 Kwh is sufficient to operator motor 210 for an extended period of time, such as several hours.

In FIG. 11 the sensor 216 is indicated at a lithology sensor, and it is understood that this may be in the form of one or a plurality of different measuring devices, each of which would function to detect different environmental parameters useful by geologists and engineers. The lithology sensor 216 generates a signal that is converted into a binary form by an analog-to-digital converter 224. The digital signal is passed to a controller 226 and the signal is stored in a memory 228.

The transporter preferably includes a collar locator 230, a type of instrument well known in the petroleum industry. The collar locator 230 produces a signal every time the transporter traverses a collar 196 in the casing (See FIG. 10). This signal is also converted by an analog-to-digital converter into a digital signal which is passed to controller 234 and to a memory device 236.

An additional element contained within the transporter is a fluid pressure sensor 238 which is not shown in FIG. 10 but which is a well known type measuring device. The pressure sensor will normally have communication exteriorally of the transporter housing 198 so as to be able to respond to the pressure of fluid in which the transporter is situated at any given time. The signal from the pressure sensor 238 is, in like manner, transported to an analog-to-digital converter 240 with the digital signal produced thereby being sent to controller 242 and memory 244. In addition, the signal from the pressure sensor is connected to an adjustable threshold device 246. When a signal of preselected magnitude from pressure sensor 238 is passed by the threshold device 246, it is impressed on a coil 248 of a bidirectional locking relay switch generally indicated by the numeral 250. When coil 248 is energized, relay 250 is moved to the "up" position so that the direction of rotation of motor 210 is such as to propel the transporter rearwardly or upwardly within the casing or the borehole. When relay 250 is in the "down" position, such as when coil 252 is energized, the direction of the rotation of motor 210 is such as to move the transporter forwardly or downwardly within the casing and borehole. In the central position of the relay switch 250, motor 210 is not energized. The purpose of the adjustable threshold device and the bidirectional locking relay switch 250 will be described subsequently.

Another detector which may be contained within the transporter 198 is an AC magnitometer 254. The signal picked up by the sensitive AC magnitometer 254 is passed by a narrow band pass fillter 256 and amplifier 258 to a rectifier 260 which, in response to the signal detected by the magnitometer 254, provides an actuating signal for coil 248. Thus the function of the magnitometer 254 is the same as that of pressure sensor 238 in that upon receipt of a signal from either source, coil 248 may be actuated to energize motor 210 to move the transporter in the upward direction when in a borehole.

Conductors from controllers 226, 234, and 242 form a part of the cable 218 connected to a plug 220 in the transporter housing. An additional conductor 262 connected to plug 220 connects with relay coil 252 which, when energized, moves the locking relay switch into the down position.

Before describing the operation of the cableless logging tool of FIGS. 10 and 11, reference is now made to FIG. 12 which shows the rudiments of surface equipment used in connection with the logging tool. A terminal apparatus 264 includes equipment necessary to receive, record, and display various signals such as collar location signals 266 and lithography information 268. Extending from terminal 264 is a cable 270 terminating in a plug 272. One conductor of cable 270, that is, 270A, connects to a momentary switch 274 which in turn is connected to a voltage source 226.

The operation of the cableless logging tool of FIGS. 10 and 11 in conjunction with surface equipment of FIG. 12 is as follows: With the bidirectional switch 250 in the center position, the logging tool is placed in casing 194 with plug 272 of the terminal secured to plug 220 of the tool. Switch 274 is momentarily closed applying a voltage to solenoid coil 252 to move relay 250 in the downward position, causing the motor 210 to be energized and rotate in a direction to propel the cableless logging tool forwardly, that is, downwardly in the casing 194. Before the tool is released, the plug 272 is disconnected from plug 220 and a waterproof cover 278 is attached to the logging tool, sealing the plug 220 and the interior of logging tool body 198 against the entrance of well fluid. The logging tool is then released and travels downwardly within the borehole. As it moves downwardly, the collar locator instrumentation provides signals indicating the presence of each collar 196 as it is passed. This information is stored in memory 236. At the same time the lithologic information is detected and stored in memory 228.

As the logging tool travels deeper into borehole 20, the pressure of the well fluid increases proportional to depth. The pressure is detected by sensor 238 and recorded in memory 244. In addition, when a preselected depth is detected, the threshold device 246 provides a signal to coil 248 moving relay 250 to the up position. This reverses the direction of rotation of motor 210, and the logging tool is then propelled upwardly in the borehole and the casing. As it moves upwardly the lithographic, collar location and pressure sensor signals are all recorded in the same manner as when the tool is moving downwardly.

When the tool returns to the earth's surface it is removed from within casing 194. Waterproof cover 278 is removed, and terminal plug 272 is connected to the logging tool plug 220, and by instrumentation within terminal 264 the contents of memories 228, 236, and 244 are read out and displayed.

In many instances, the logging tool will be required to extend to a depth in the borehole behind which a casing has been set; therefore, no collar indications can be given. In this instance the lithographic information can be correlated with the pressure sensing information as an indirect indication of depth.

In some instances it is desirable to provide communication between the earth's surface and the logging tool after the tool has left the earth's surface. One means of accomplishing this is by the use of a coil of wire 279 formed around the borehole with the borehole as an axis. The coil 279 may be laid upon the surface of the earth or buried just below the surface and should be of a diameter of 5 to 10% of the maximum depth for which communication is desired. For instance, if the borehole 20 has a depth of 10,000 feet, coil 279 should have a diameter of 500 to 1,000 feet. When a powerful low frequency generator 280 is connected to coil 279 by the closure of switch 282, a low-frequency alternating magnetic field is generated by the coil 279 and picked up by a magnitometer 254. The AC signal received by the magnitometer 254 is passed by the narrow band pass filter 256 (see FIG. 11), amplified at 258, rectified at 260 to thereby provide an actuating signal to the up coil 249. In this manner, if the pressure sensor signalling system utilized to reverse the direction of movement of the logging tool fails, the direction can be reversed from the earth's surface. It can be seen that the signal produced by the magnitometer 254 and available at rectifier 260 may be arranged so that upon receipt of the first signal the switch is moved to the up position, and upon receipt of a subsequent signal, to the down position so that the movement either up or down of the logging tool may be controlled from the earth's surface by means of coil 279. This can be particularly useful in unsticking the logging tool if it becomes lodged in the casing or borehole for any reason.

While a pressure sensor 238 is indicated as one means of detecting the depth of the logging tool, another means is the use of a wheel which engages the sidewall of the casing 198 or borehole 220 such as wheel 88 of FIG. 2. This measuring system can be employed to provide an indication and record of depth, and circuitry may be provided to automatically reverse direction of the logging tool when a preselected depth is reached. Another means of detecting depth is the use of inertial guidance systems such as has been described with reference to the embodiment of the cable transporter of FIG. 1.

Other means may be employed to communicate between the cableless logging tool of FIG. 10 such as the use of an explosive charge provided by a rifle or shotgun shell fired by a mechanim 284 at the earth's surface, with the sound being transmitted into the interior of the casing and received by a microphone 286 within transporter 198. Apparatus for generating signals by explosive shot in a casing is available from Keystone Engineering Company of Houston, Tex.

In the embodiments of the transporter illustrated in FIGS. 1–6 wherein cable 24 is securely attached to the rearward end of the transporter, it is important that the transporter not be permitted to rotate, as has been previously explained. Another concept of this invention is to utilize the advantage of a rotating transporter body, in combination with a rotational connection with the cable extending to the earth's surface, to either reduce the friction of the transporter body against the borehole sidewall, or to use such rotation as a positive means of advancing the transporter. It is easily recognized that when a device is to be passed through a borehole the friction of the device against the borehole sidewall is reduced or substantially eliminated if the device is rotated. This concept may be successfully utilized by a transporter which is caused to rotate as long as it does not simultaneously rotate the cable attached to it.

FIG. 13 shows a transporter in which the body 22 is encouraged to rotate by the mounting of a single large propeller 288 to move fluid past the body and thereby provide motive force. The shaft 30 extending from motor 28 connects directly with the propeller 288, and it can be seen that with the large diameter propeller rotating in fluid 26 contained in the borehole that the transporter body 24 will inevitably be rotated. To prevent twisting of cable 24, a rotatable or swivel connector 290 is employed. The rotatable connector 290 consists of a first part 290A which is attached to the body 24, such as by means of a conduit 292 extending from the body in which the cable is contained. The other part 290B is attached to cable 24. The portions 290A and 209B provide multiple conductor connections such as by the use of slip rings (not shown but well known in the industry). To help ensure that cable will not be rotated by the rotation of body 22, the connector portion 290B may be provided with an eccentric weight 294 which will resist rotation if the transporter is in a borehole inclined relative to the vertical. Another means of preventing rotation of cable 24 includes the use of a mechanism affixed to the cable only to slide against the borehole sidewalls, such as flexible bow springs as illustrated in FIG. 10.

When the transporter is particularly designed to rotate as it moves through the drilling fluid it may have a smooth external body surface so that the rotation merely serves to reduce the friction of the transporter with the borehole sidewall or, as shown in FIG. 13, the rotation of the transporter body may be employed to axially advance or assist in the axial advancement of the body. In this arrangement, an expandable bladder 296 is employed, much like the bladder shown in FIG. 4 except that the bladder has on the external surface a spiralled helix 298 either as a separate item or integrally formed with the bladder. By the effect of the helix 298 the rotation of the transporter body 22 will cause it to axially advance in the drilling fluid. The external circumferential diameter of the helix 228 may be less than the internal diameter of borehole 20 as shown so that the transporter will be moved by the propulsion force applied by propeller 288. In addition, the effect of the helix 298 within the well fluid and against the borehole sidewall will cause axial advancement of the transporter.

As an alternative arrangement, it can be seen that the bladder 296 may be of a diameter so that when expanded it will engage the peripheral surface of the helix 298 with the borehole sidewall around the full periphery of the body to positively ensure the axial advancement of the transporter as it rotates.

The bladder 296 may be expanded or contracted as has been previously discussed with reference to FIG. 4, employing a small motor 48 controlled by an instrumentation package 64. The motor 48 may be reversible so that fluid 44 may be pumped from within a collapsible reservoir 300 to expand the bladder or pumped from the bladder back into the reservoir when it is desired to decrease the diameter of the bladder, and thereby helix 298, such as when it is desired to extract the transporter from the well by upward pull on cable 24.

Another means of utilizing the rotation of a transporter body to axially advance it in a borehole is illustrated in FIG. 14. In this arrangement, the body of the transporter is formed of two portions, 302 and 304. The portion 302 has a helix 302A on the external surface and body portion 304 has a helix 304A on its external surface. In the illustrated arrangement of FIG. 4 both the helix 302A and 304A are supported directly on the body external surface and are not expandable or collapsible, and may be of a diameter as illustrated which is less than that of borehole 20 or, if desired, may be substantially equal to the diameter of the borehole 20.

Motor 28 mounted in body 302 has a shaft 306 rotatably extending from the forward end of the body 302 and connected to the rearward end of the body portion 304. When shaft 306 is rotated it will rotate the forward body 304 clockwise as viewed from the rearward end of the body. The counteractive force will cause the rearward body 302 to rotate in the opposite direction, that is, counterclockwise as viewed from the rearward end. By reversing spiral 302A relative to spiral 304A, this counter-rotation causes axial advancement of the body portions 302 and 304 to move the transporter through borehole 20.

An additional arrangement employing a rotating transporter is in FIG. 15. Body 22 has helix 308 on the exterior circumferential surface. Positioned within the body is a gyroscopic device 310 supported about two rotatably supported shafts 312 and 314. Shaft 314 is connected by a coupling device 316 to the output shaft 318 of a gear motor 320. The gyroscopic device 310 is configured to resist rotation; and therefore, the shaft 314 is non-rotatable relative to the earth. Motor 320 provides on output shaft 318 a rotative force. Since the rotative force is applied to the gyroscopic device 310 which resists rotation, the effect is to cause the motor 320 to rotate while the output shaft 318 remains non-rotating. This applies a rotational torque to the transporter housing 22. By the effect of helix 308 the transporter will be axially advanced in the borehole.

To assist in the axial advancement, a propeller 322 may be mounted at the forward end of the housing, rotated by shaft 324 from a drive motor 28 in the same manner as has been previously described with reference to FIGS. 5 and 13. Axial force applied to the rotating propeller causes the transporter to advance in the borehole. It is also possible to combine the rotational force achieved by the employment of the gyroscopic device 310 with the tendancy of the body to rotate by the effect of propeller 322.

As has been previously indicated, the embodiments of FIGS. 13, 14, and 15 may be employed with or without external helical devices. Where the helical devices are not employed the effect of rotation is to merely reduce the friction of the transporter as it engages the sidewalls of the borehole whereas when helical elements are applied to the external surface of the rotating bodies positive axial advancement of the transporter is achieved.

Another embodiment of the invention is shown in FIGS. 16 through 20 which involves only reduction of friction between the logging tool and the well wall.

It is well known that so called "solid friction" as the "newtonian" or liquid friction disappears when the interacting bodies are in motion between one another. Thus *sliding friction* between two solid bodies is characterized by a threshhold which is known as *starting friction.* After the starting friction is overcome and a velocity V is achieved between the two bodies, further increases in velocity require very little added force to increase velocity. For example, if a body is placed on an inclined plane and the angle of inclination is very small, say 5°, the body will not slide down the plane. If, however, the body is vibrated (either longitudinally or *laterally*) the body will slide down the plane.

In my invention I can take advantage of this phenomenon to cause the logging tool to slide down even when the angle with the horizontal is very small. Referring to FIG. 16, cable 24 must be very light or buoyant as for example a Kelvar cable that has a specific density very close to 1 or that of water. The drag of the cable, therefore, is negligible. The transporter 22 is coupled to the logging tool or instrument package 154 by an angularly rigid connector 152. Thus, if an angular displacement is impressed on transporter 22 it will also turn the logging tool 154 by a like angle. Transporter 22 contains a device that will impart to it angular oscillation of many degrees i.e. possibly as much as two full turns clockwise followed by two full turns counterclockwise in continuous cycles, first rotating one direction then another.

One way to achieve cyclic rotation of the transporter 22 is illustrated in FIG. 17. A heavy flywheel 400 has as axis of rotation concentric with the longitudinal axis of the transporter body, and is rotatably supported by shaft 402. A motor 404, which may be a gear motor, is supported to the housing of the transporter body and is energized by way of a reversing switch 406 and battery 408. Switch 406 is controlled by a timer 410. The reaction force from the angular acceleration of flywheel 400 will cause transporter body 22 to revolve, thus also causing revolution about its longitudinal axis of the logging tool 154. The number of revolution in one direction before the direction of rotation is reversed should not be a great number so that not more than a few turns of twist is applied to cable 24 in any direction before the direction of twist is reversed. In this way a rotatable coupling, such as employed in the embodiment of FIGS. 13, 14 and 15 is not required.

Rather than using a large mass flywheel, FIG. 18 illustrates the use of a gyroscope generally indicated by numeral 412. A circumferential gear 414, the axes of which is concentric with the longitudinal axis of body 22 is secured to the body and is engaged by small gears 416 affied to the shafts of the gyro. By a mechanical switching arrangement (not shown) the rotation of the body relative to the fixed axis of rotation of the gyroscope may be employed to rotate the transporter body first one direction then the other.

FIG. 19 shows another way of rotating the transporter by internal means. A shaft 418 which is eccentric to the transporter longitudinal axis supports a large eccentric weight 420. A small gear 422 secured to arm 424 engages a ring gear 426. Upon rotation of gear 422, such as by means of a battery powered motor, not shown, first in one direction and then another, the transporter 22 will rotate in the borehole.

It is apparent that each of the transporters as illustrated in FIGS. 13 to 20 (as well as each of the transporters illustrated in FIGS. 1 to 6 as mentioned hereinabove) can be employed in conjunction with a lightweight cable as described hereinabove. The total weight of such a lightweight cable is not substantially greater than the volume of well fluid the cable displaces; that is, the cable is substantially weightless in the well fluid. Such a cable, as mentioned above, can be effectively manufactured using a product of DuPont sold under the trademark "Kevlar". "Kevlar" is an aramid fiber of lightweight and high tensile strength. It has a density of 1.44 grams per cubic centimeter versus a density of 2.55 for fiberglass. It has a tensile strength of 525,000 PSI.

With the use of such a lightweight cable one can minimize the friction caused by the interaction of the cable with the wall of the borehole during the downward or upward motion of the transporter housing. Thus the use of the transporter as shown in either of FIGS. 13 to 20 in conjunction with a lightweight cable provides a means for minimizing the friction of the transporter with the borehole sidewall as well as minimizing the friction of the cable with the borehole sidewalls.

Important features of my invention are:

1. To cause the sonde to rotate angularly around its own axis in succeeding right hand and left hand sense.

2. To prevent any accumulation of turns in any one sense so as not to tangle or twist the cable.

One method of accomplishing this result is shown in FIG. 20 taken with FIG. 17. A weight 428 is connected to shaft 430 which connects to gear 432. After a certain number of revolutions of the transporter have taken place, the switch 434 will move from the neutral position to the positive side of battery and thus introduce an added voltage to the motor 404 of FIG. 17 by way of conductors 436 which may be contained in cable 152, and thus cause the flywheel 400 to accelerate in one direction more than in the opposite direction. Any accumulated rotations of the transporter in a given direction will be counteracted by the added torque to the motor.

Conversely should the total number of revolutions in the other direction exceed a predetermined number, switch 434 will move to the opposite position and provide an incremental current to the motor 404 of FIG. 17 to cause the transporter to rotate in the opposite direction. Thus any accumulation of turns in one or the opposite direction is avoided.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. Apparatus for transporting and/or logging equipment in a borehole having fluid therein, comprising:

a transporter body dimensioned to be positioned in a borehole;

means carried by said body to at least substantially contact the borehole wall around substantially the entire circumference thereof to form a piston relationship between said transporter body and the borehole; and means for moving fluid past said transporter body to create a differential fluid pressure across said means forming said piston relationship to thereby cause the transporter body to move in the borehole.

2. The apparatus of claim 1 wherein said means forming a piston relationship with the borehole is expandable and contractable.

3. The apparatus of claim 2 wherein said means forming a piston relationship with the borehole is in the form of a flexible container affixed to the exterior circumferential surface of said body.

4. The apparatus of claim 3 including pump means carried by said body by which fluid may be forced into said annular flexible container to expand the container.

5. The apparatus of claim 4 wherein said pump means is reversible whereby fluid may be forced into said annular flexible container to expand the container or withdrawn so as to collapse the container.

6. The apparatus of claim 3 wherein said flexible container is of elastomeric material.

7. The apparatus of claim 1 wherein said fluid moving means moves fluid through at least a portion of said body.

8. The apparatus according to claim 1 in which said means affixed to the external surface of said body forming a piston relationship with the borehole includes at least one circumferential flexible cup means.

9. The apparatus of claim 1 including:

an instrument housing having measuring and/or logging equipment therein, the instrument housing having a diameter less than the diameter of the borehole permitting free movement within the borehole;

and means connecting said transporter body to said instrument housing.

10. Cableless apparatus for making measurements in a borehole having fluid therein, comprising:

a transporter body of diameter less that of the borehole;

means to propel the body forwardly and rearwardly in the borehole fluid;

an energy storage means within the transporter body connected to said propulsion means;

at least one measuring instrument carried by said transporter body providing a recorded measurement signal;

means to actuate said propulsion means to move said body forwardly and downwardly in the borehole;

and means to actuate said propulsion means to move said body rearwardly and upwardly in the borehole.

11. Apparatus for transporting measuring and/or logging equipment in a borehole having fluid therein, comprising:

an elongated transporter body;

means carried by said body to cause the rotation thereof in the borehole; and means of non-rotatably attaching a cable to the rearward end of said body.

12. A cableless apparatus for making measurements in a borehole according to claim 11 wherein said reversing means is a pressure indicator carried by said transporter body providing a reversing signal when a preselected pressure is reached.

13. A cableless apparatus for making measurements in a borehole according to claim 11 wherein said reversing means includes a magnitometer carried by said transporter body and including a coil situated at the earth's surface with the borehole as an axis and means to impart a low frequency signal to said coil to provide a signal detectable by said magnitometer.

14. A cableless apparatus for making measurements in a borehole according to claim 11 wherein said reversing means includes a microphone carried by said transporter body and means for generating a high intensity sound in the borehole at the earth's surface.

15. A cableless apparatus according to claim 11 including memory means carried by said transporter body for storing signals derived from said measuring instruments, and means at the earth's surface connectable to said transporter to receive and record information from said memory means.

16. A cableless apparatus according to claim 11 wherein the borehole has lengths of casing therein secured to each other by casing collars to form a casing string and including a casing locator instrument carried by said transporter body for providing signals indicative of the presence of casing collars;

means to record said collar location signals; and means to correlate said collar location signals with said measurement signal.

17. Apparatus for transporting measuring and/or logging equipment in a borehole having fluid therein, comprising:

a transporter body dimensioned to be received in a borehole and having a forward and rearward end;

means to propel said body in the borehole fluid;

a cable extending from said transporter body to the earth's surface;

means of carrying an additional length of cable with said body; and means of releasing said additional length of cable whereby said body may move forward for a distance equal to the length of said additional cable without pulling the cable extending to the earth's surface with it.

18. Apparatus according to claim 17 including:

a cable storage housing having a diameter less than the borehole, said additional length of cable being stored within said housing, the housing having a forward and rearward end, said cable extending to the earth's surface being secured to the storage housing rearward end; and means of connecting the forward end of the cable housing to said transporter body.

19. Apparatus for transporting measuring and/or logging equipment in a borehole having fluid therein, comprising:

a transporter body of normal diameter less than the borehole, the transporter body carrying a plurality of subsurface sensors;

electric powered means of propelling said transporter body through the fluid with the borehole;

a cable extending from said transporter body to the earth's surface, the cable being formed at least in part by a plurality of information carrying conductors; and means of controllably switching said plurality of information carrying conductors from one mode in which different conductors connect different said subsurface sensors to logging electronics at the earth's surface; and in another mode in which said information carrying conductors are in parallel and connected to carry electrical energy from the earth's surface to said electric powered means of propelling said transporter body.

20. Apparatus for transporting measuring and/or logging equipment in a borehole having fluid therein, comprising:

a transporter body of normal diameter less than the borehole;

a cable attached to said transporter body extending to the earth's surface;

means within said transporter of propelling it within said borehole by reaction with the fluid in the borehole; and means of retarding the rotation of the transporter body as it advances in the borehole.

21. Apparatus for transporting measuring and/or logging equipment in a borehole having fluid therein, comprising:

a transporter body of normal diameter less than that of a borehole;

a lightweight cable affixed to said body and extending to the earth's surface, the cable being of specific gravity not substantially greater than the borehole fluid; and means carried by said body of providing a positive motive force for moving said body and for pulling said cable within the borehole.

* * * * *